US007282000B2

(12) United States Patent
Brine, III et al.

(10) Patent No.: US 7,282,000 B2
(45) Date of Patent: Oct. 16, 2007

(54) ARTICULATED LACROSSE STICK

(75) Inventors: William H. Brine, III, Hopkinton, MA (US); Barclay Moore, Homewood, CA (US)

(73) Assignee: Sport Helmets, Inc., Liverpool, NY (US)

( * ) Notice: Subject to any disclaimer, the term of this patent is extended or adjusted under 35 U.S.C. 154(b) by 0 days.

(21) Appl. No.: 10/800,560

(22) Filed: Mar. 15, 2004

(65) Prior Publication Data

US 2005/0075200 A1 Apr. 7, 2005

Related U.S. Application Data

(60) Provisional application No. 60/455,027, filed on Mar. 14, 2003.

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/505, 512; D21/724; 401/23
See application file for complete search history.

(56) References Cited

U.S. PATENT DOCUMENTS

| | | | | | |
|---|---|---|---|---|---|
| 303,517 | A | * | 8/1884 | Hubbard | 401/23 |
| 537,927 | A | * | 4/1895 | Kennedy | 473/520 |
| 3,357,035 | A | * | 12/1967 | Ficke | 15/144.1 |
| 3,910,578 | A | * | 10/1975 | Brine, Jr. | 473/513 |
| 4,034,984 | A | | 7/1977 | Crawford et al. | |
| 4,037,841 | A | | 7/1977 | Lewis, Jr. | |
| 4,097,046 | A | | 6/1978 | Friant | |
| 4,206,918 | A | | 6/1980 | Lewis, Jr. | |
| 4,367,871 | A | * | 1/1983 | Schiefer | 473/463 |
| 4,657,260 | A | | 4/1987 | Brine, Jr. | |
| 4,739,994 | A | | 4/1988 | Lewis, Jr. | |
| 4,940,243 | A | | 7/1990 | Tucker et al. | |
| 5,007,652 | A | | 4/1991 | Tucker et al. | |
| 5,263,711 | A | | 11/1993 | Addis et al. | |
| 5,609,336 | A | | 3/1997 | Tashjian | |
| 6,189,222 | B1 | * | 2/2001 | Doyle | 30/531 |
| 6,241,629 | B1 | * | 6/2001 | Otto | 473/457 |
| RE38,216 | E | * | 8/2003 | Morrow et al. | 473/513 |
| 6,752,730 | B1 | * | 6/2004 | Brine et al. | 473/513 |
| 6,783,471 | B2 | * | 8/2004 | Bolduc et al. | 473/457 |
| 2003/0181271 | A1 | | 9/2003 | Mitzak | |

FOREIGN PATENT DOCUMENTS

| | | | |
|---|---|---|---|
| GB | 1589596 | * | 5/1981 |

* cited by examiner

*Primary Examiner*—Eugene Kim
*Assistant Examiner*—M. Chambers
(74) *Attorney, Agent, or Firm*—Alan G. Towner, Esq.; Pietragallo Bosick & Gordon, LLP

(57) ABSTRACT

An articulated lacrosse stick having a head portion, a handle portion and an articulation mechanism capable of moving a first portion of the stick from a first position to a second different position with respect to a second portion of the stick is disclosed. The head portion may be articulated with respect to the handle portion. A first handle portion of stick may be articulated with respect to a second handle portion.

25 Claims, 24 Drawing Sheets

ARTICULATED LACROSSE STICK

CROSS-REFERENCE TO RELATED APPLICATION

This application claims the benefit of U.S. Provisional Patent Application Ser. No. 60/455,027 filed Mar. 14, 2003, which is incorporated herein by reference.

FIELD OF THE INVENTION

This invention relates to a lacrosse stick, and more particularly relates to an articulated lacrosse stick having an articulated or pivoting connection between the head portion and the handle portion.

BACKGROUND INFORMATION

The sport of lacrosse requires players to use a lacrosse stick to catch a ball, cradle and control the ball and pass the ball to another player or shoot the ball into a goal. The lacrosse stick typically comprises two portions: a head portion and a handle portion. The head is typically constructed to receive the ball and release the ball from a pocketed or basket area while the handle is typically constructed to allow the player to impart momentum to the ball by using upper body strength. Traditional lacrosse sticks are substantially rigid in that they do not flex during use. Some sticks have a one-piece design in which the head and stick handle are jointly formed from a single piece of wood, metal or plastic. Other sticks have a two-piece design in which the head and stick handle are independently fabricated and subsequently joined together in rigid fashion. Stick handles have typically been formed of wood, metal, such as aluminum, or plastic. Stick heads are typically formed of a tough thermoplastic material, however, some are also formed of wood or metal. Sticks having a two-piece design typically include a socket element to allow the stick handle to be rigidly attached to the head.

The head of a lacrosse stick is typically attached to the stick in a coaxial orientation. Typically, the frame head comprises at least one sidewall element that extends away from the handle portion of the stick and forming an open mouth for receiving a lacrosse ball. Suspended from the open mouth is a netting, mesh or other material that defines a basket in which the lacrosse ball is received, and from which a lacrosse ball may be passed.

Historically, lacrosse sticks were fabricated from a single piece of high-grade ash or hickory wood. However, with the decreasing availability of quality woodworking skills necessary to fabricate lacrosse sticks having integral one-piece wooden stick-head configuration, it has become commonplace to fabricate two-piece lacrosse sticks having a separate stick handle and head portion. Stick handles are typically made of straight-grained wood, wood laminate or a tough, lightweight metallic or reinforced plastic tubular material. Thin gauge metallic extrusion, such as aluminum, or tough polymeric materials, such as fiber reinforced composite plastics, are typically the most suitable materials for lacrosse stick handles. Head frames are typically formed from a tough synthetic thermoplastic material, such as high impact strength nylon. Atypically, the frame head and stick handle are fastened together at the socket by a fastener. A screw, rod or other equivalent fastener typically extends through the frame head and stick handle at the coaxial socket to rigidly join both pieces together.

Traditional one-piece and two-piece design lacrosse sticks are substantially rigid, such that they do not exhibit much flex during use. In a two-piece design, both pieces are fastened together such that the frame head and stick handle remain in the same plane at all times.

Accordingly, a need remains for an articulated lacrosse stick that allows the head to pivot with respect to the stick handle. Such pivoting action would increase the effectiveness of scooping the ball from the ground as well as improving the passing accuracy of the user. Other benefits of an articulated stick include easier throwing and catching, and improved shock absorption. The articulation mechanism would also allow the head portion of the stick to follow the contour of the ground when a user attempts to scoop a ball off the ground, thereby reducing the chance of injuries while scooping.

The present invention has been developed in view of the foregoing.

SUMMARY OF THE INVENTION

The present invention includes a lacrosse stick having an articulation mechanism that allows a portion of the stick to move from a first position to a second different position with respect to another part of the stick. For example, the head portion of the stick can move with respect to the handle portion, a first handle portion can move with respect to a second handle portion, or a first head portion can move with respect to a second head portion.

An aspect of the present invention is to provide a lacrosse stick comprising a handle, and an articulated head connected to the handle.

Another aspect of the present invention is to provide an articulated lacrosse stick comprising a handle and a head, and means for articulating the head with respect to the handle.

Another aspect of the present invention is to provide an articulation mechanism for use with a lacrosse stick having a head and a handle, the articulation mechanism comprising a first element and a second element connected to the first element such that the first element can pivot or hinge with respect to the second element.

Yet another aspect of the present invention is to provide an articulation mechanism for use with a lacrosse stick having a head and a handle, the articulation mechanism comprising means for connecting the head to the handle, and means for displacing the head from the longitudinal axis of the handle.

These and other aspects of the present invention will be more apparent from the following description.

DETAILED DESCRIPTION

Figure 1:
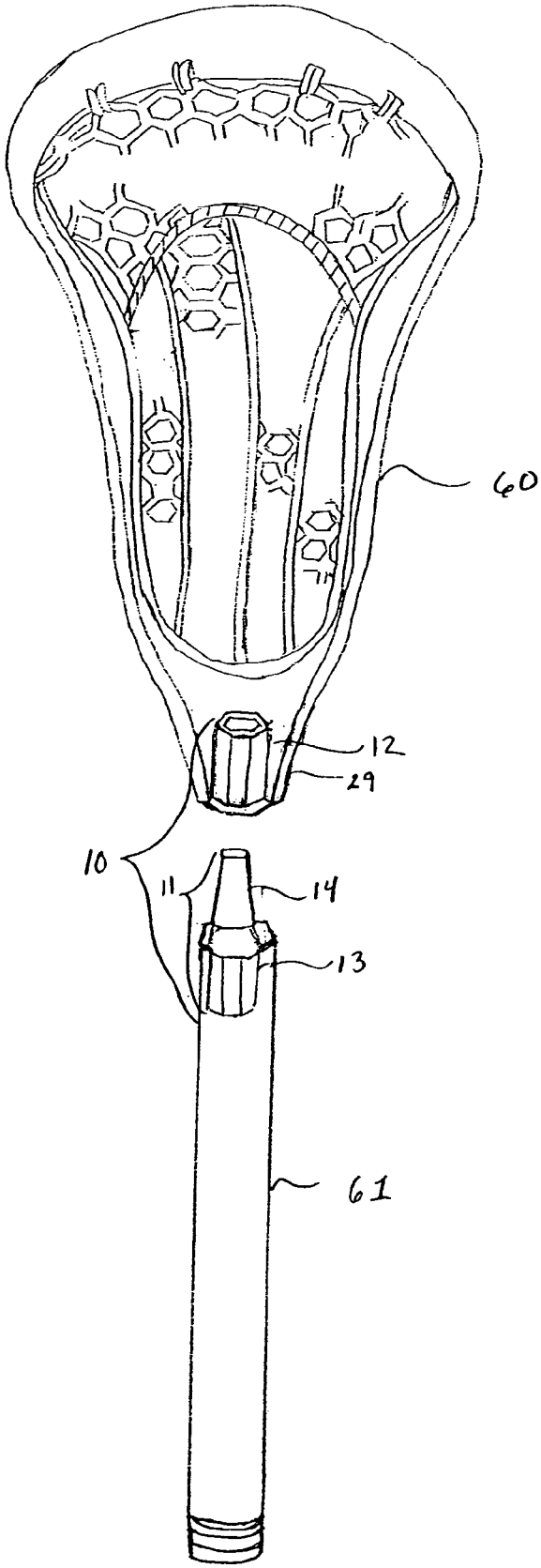
FIG. 1 is a pictorial representation of a disassembled lacrosse stick having a cut-away region showing the first element and second element of the articulation mechanism in accordance with an embodiment of the present invention.

Lacrosse sticks typically comprise a head portion 60 and a handle portion 61. As shown in FIG. 1, an articulation mechanism 10 can be incorporated into the head portion 60 and the handle portion 61 in order to allow an otherwise rigid lacrosse to articulate in response to an applied force. Articulation mechanism 10 comprises a first element 11 and a second element 12. In one embodiment, the first element 11 is housed within the handle portion 61 of a lacrosse stick and the second element 12 is housed within the head portion 60. In another embodiment, the first element 11 is housed within the head portion 60 and the second element 12 is housed within the handle portion 61. An already existing lacrosse stick can be easily retrofit to include the articulation mechanism 10 of the present invention.

Figure 2:
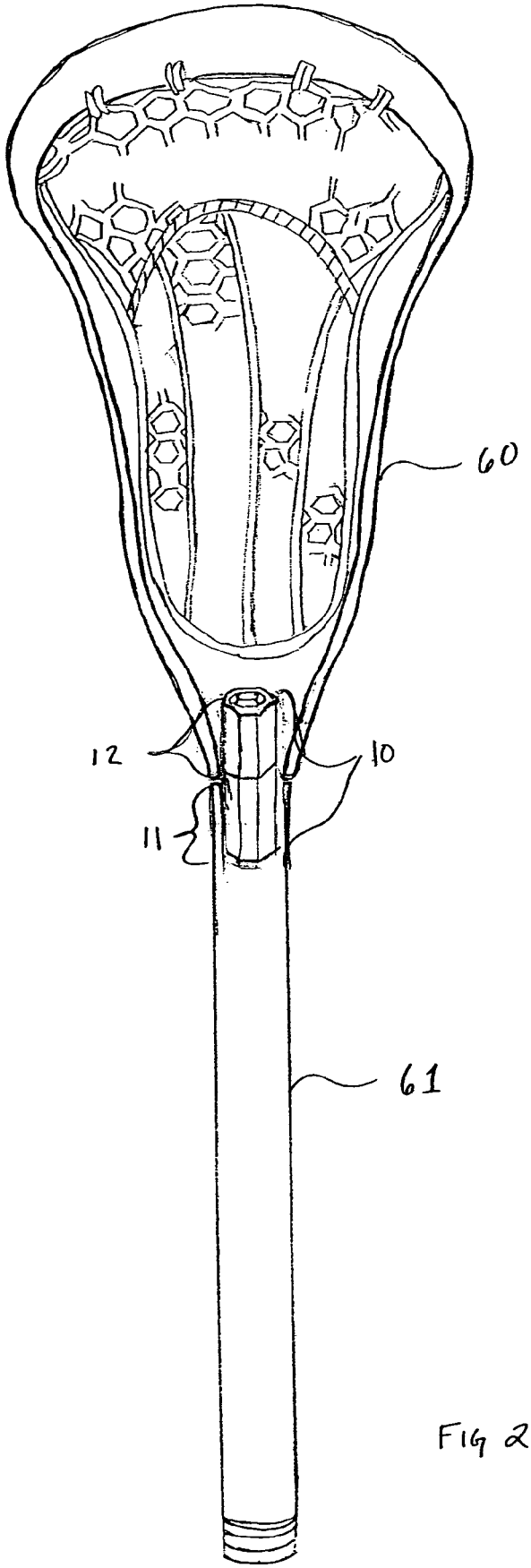
FIG. 2 is a pictorial representation of a lacrosse stick having a cut-away region showing the articulation mechanism in the rest position in accordance with an embodiment of the present invention.

Some lacrosse sticks are hollow, making it easy to simply slide the first element 11 and second element 12 into the respective head portion 60 and handle portion 61. Other lacrosse sticks are solid, requiring that the handle portion 61 and head portion 60 be drilled to accommodate the first element 11 and the second element 12. FIG. 1 shows a lacrosse stick in a disassembled configuration in which the second element 12 is housed within the base 29 of head portion 60 and the first element 11 is housed within the handle portion 61. In this embodiment, the first element 11 comprises a base portion 13 and an extended portion 14 that is sized to slidably engage the second element 12 in the assembled configuration as shown in FIG. 2. The articulation mechanism 10 may be contained inside the lacrosse stick, such that there are substantially no parts of articulation mechanism 10 external to the lacrosse stick head portion 60 and/or handle portion 61.

Figure 3:
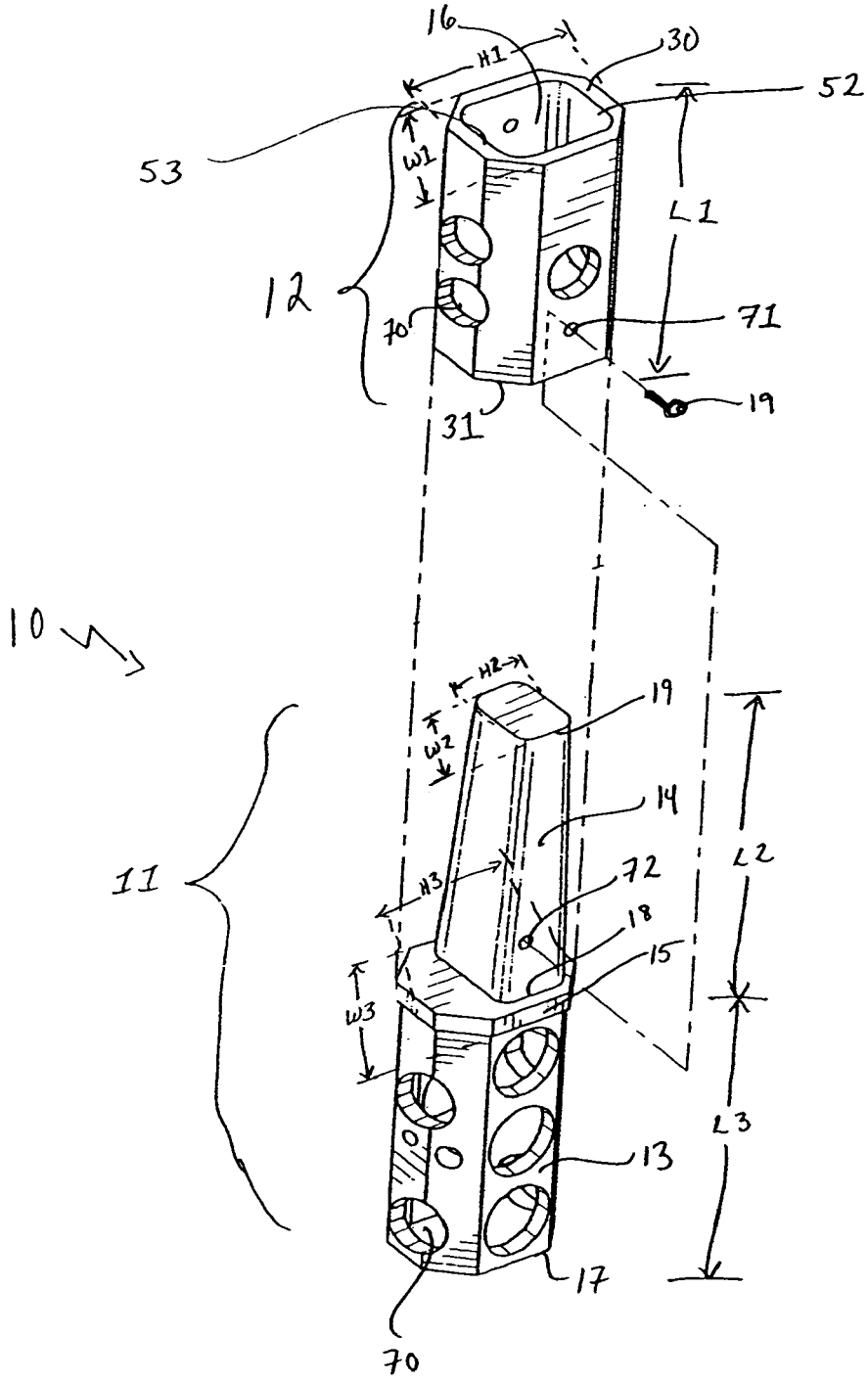
FIG. 3 is an exploded view diagram of the first element and the second element of the articulation mechanism in accordance with an embodiment of the present invention.
Figure 4:
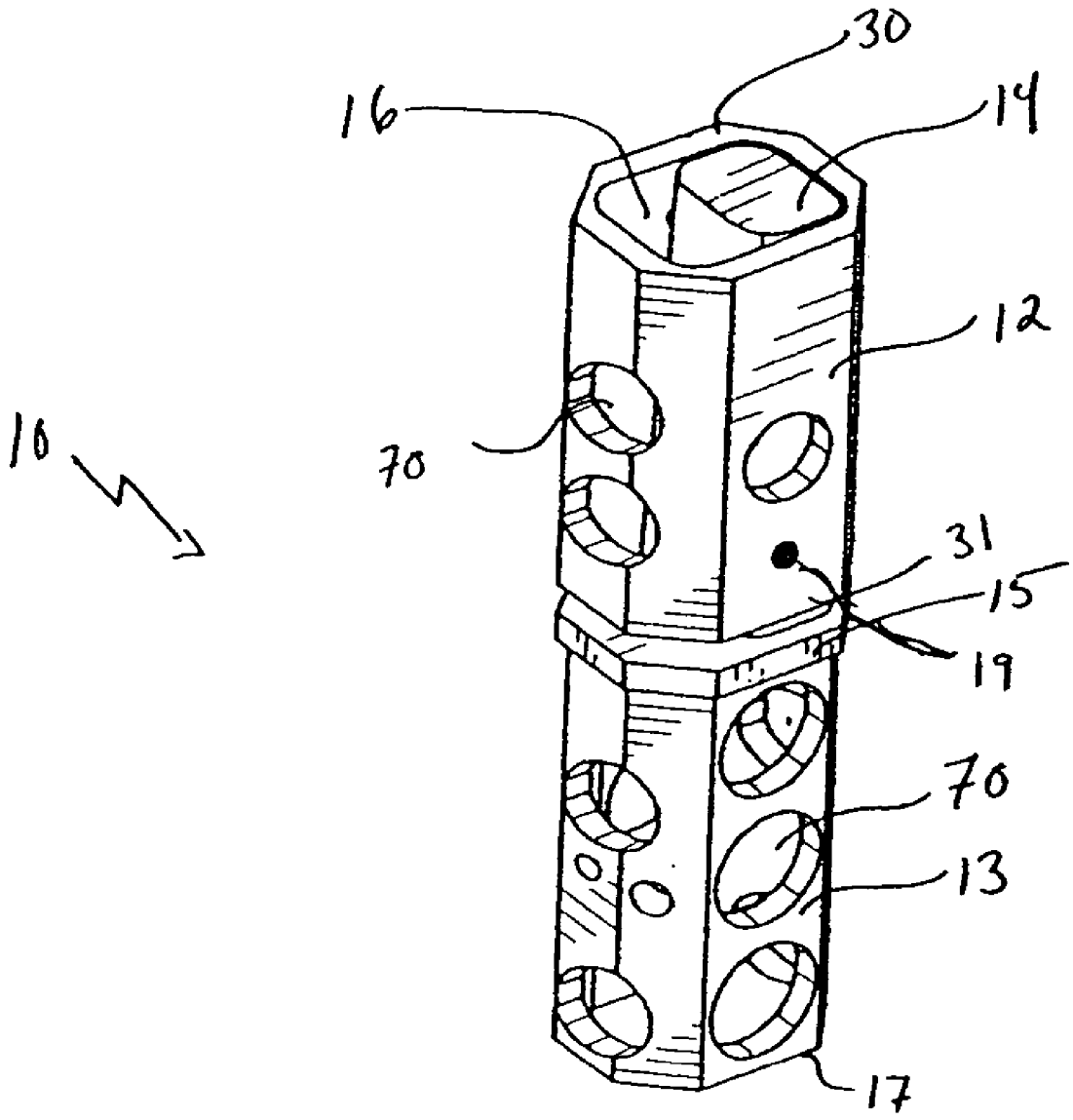
FIG. 4 is a diagram of the articulation mechanism of FIG. 3 is an assembled configuration in accordance with an embodiment of the present invention.
Figure 5:
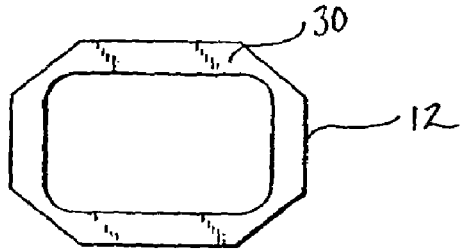
FIG. 5 is top view of the second element of the articulation mechanism in accordance with an embodiment of the present invention.
Figure 6:
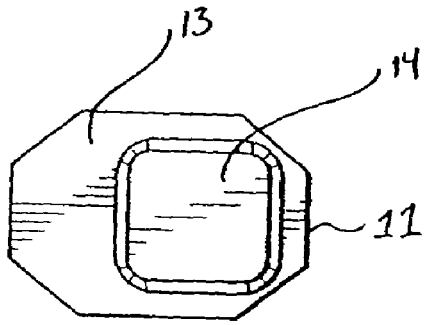
FIG. 6 is a top view of the first element of the articulation mechanism in accordance with an embodiment of the present invention.

FIGS. 3 and 4 schematically illustrate an articulation mechanism 10 of the present invention. Second element 12 having length LI comprises a top end 30, a bottom end 31 and an interior 16. First element 11 comprises a base portion 13 and an extended portion 14, having a reduced diameter as compared to the base portion 13. The extended portion 14 is sized to slidably enter the interior 16 of the second element 12. FIG. 5 shows the top view of second element 12 as shown from the top end 30 looking along a longitudinal axis toward the bottom end 31 (not shown). FIG. 6 shows the top view of first element 11 as shown from the extended portion 14 looking along a longitudinal axis toward the base portion 13.

Figure 7:
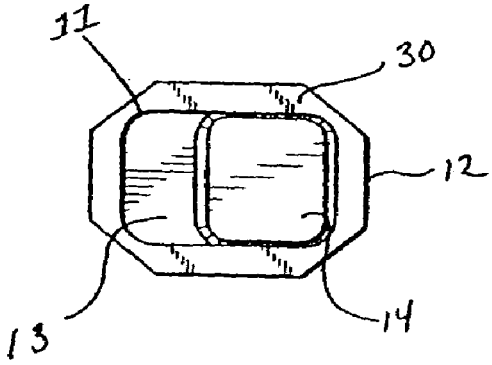
FIG. 7 is a top view of the articulation mechanism in an assembled configuration in accordance with an embodiment of the present invention.

In one embodiment of the present invention, as shown in FIG. 4, the extended portion 14 of the first element 11 can be inserted into the interior 16 of the second element 12 to achieve an assembled configuration. In the assembled configuration, the top end 15 of the base portion 13 of the first element 11 can be flush with the bottom end 31 of the second element 12. FIG. 7 shows the top view of the first element 11 and the second element 12 in the assembled configuration looking from the extended portion 14 of the first element 11 along a longitudinal axis toward the base portion 13 of the first element 11. A user will typically play with the articulation mechanism 10 in the assembled configuration.

In one embodiment, the base portion 13 and the extended portion 14 of the first element 11 are integrally formed. In another embodiment, the base portion 13 and the extended portion 14 are separately formed and subsequently fastened together by welding, bonding, gluing or other adhering means. Base portion 13 comprises a top end 15 and a bottom end 17. Extended portion 14 can be fixedly attached to the top end 15 of the base portion 13. In one embodiment, the top end 15 of the base portion 13 comprises a solid plate to which the extended portion 14 can be centered and attached. In another embodiment, the extended portion 14 can be offset with respect to the center of the base portion as shown in FIGS. 3 and 6.

The first element 11 and the second element 12 are sized to have any dimensions such that they may be housed within the handle portion 61 and/or head portion 60 of a lacrosse stick. In one embodiment, as shown in FIGS. 3 and 4, the second element 12 typically has a length L1 of from about 1 inch to about 2.5 inches, a height H1 of from about 0.5 inch to about 1 inch, and a width W1 of from about 0.5 inch to about 1 inch. The first element 11 comprises a base portion 13 having a length L3 and an extended portion 14 having a length L2. In one embodiment, the combined length of L2 and L3 is from about 0.5 inch to about 3 inches. In another embodiment, the extended portion 14 has a width W2 and/or a height H2 that is smaller than width W3 and/or height H3 of the base portion 13. The height H3 of the base portion 13 can be from about 0.5 inch to about 1 inch and the width W3 of the base portion can be from about 0.5 inch to about 1 inch. The height H2 of the extended portion 14 can be from about 0.25 inch to about 1 inch and the width W2 of the extended portion 14 can be from about 0.25 inch to about 1 inch. The extended portion 14 can also have any width W2 and height H2 that is smaller than the width W1 and height H1 of interior 16 of the second element 12.

As shown in FIG. 3, the extended portion 14 can be tapered from the extended portion base 18 to the extended portion top 19 in at least one dimension or in multiple dimensions. In this embodiment, the width and/or height of the extended portion top 19 is smaller than the width and/or height of both the extended portion base 18 and the interior 16 of the second element 12. In another embodiment, the extended portion 14 can comprise a rod having a diameter of from about ⅛ inch to about 1 inch. The rod can be located at the center of the base portion 13 or offset from the center of the base portion 13. In yet another embodiment, the extended portion 14 can comprise a square cross section configuration.

First element 11 and second element 12 may be joined together by a fastener 19 that allows the first element 11 and/or the second element 12 to pivot or hinge with respect to the other element. Suitable fasteners include joining rods, pivot pins, screws, rivets, bolts or the like. In one embodiment, first element 11 comprises a fastener hole 72 and second element 12 comprises a fastener hole 71 that aligns with fastener hole 72 when the first element 11 and the second element 12 are in the engaged position. Fastener 19 can be provided through fastener hole 71 and fastener hole 72 and fastened by the appropriate means such as nuts, anchors, rivet backings and the like. In another embodiment, fastener hole 72 extends through the entire width of first element 11 and second element 12 comprises a pair of fastener holes 71, each of which align with fastener hole 72 to allow a fastener 19 to be positioned through the entire width of the first element 11 and the second element 12. In another embodiment, fastener hole 20 is located in the extended portion 14 of the first element 11.

The articulation mechanism 10 is configured to move between a rest position and a flexed position. In one embodiment, the rest position is in a first plane and the flexed position is in a second plane that is different from the first plane. The second plane may be in a forward direction from the first plane. Alternatively, the second plane may be in an aft direction from the first plane. The articulation mechanism 10 may move from the rest position, e.g., both forward and aft of the rest position. In another embodiment, the second plane is in an aft direction from the first plane. In yet another embodiment, the second plane is in a sideward direction from the first plane. In another embodiment, the second plane is in an opposite sideward direction. Articulation mechanism 10 can move in a plurality of fore-and-aft directions as well as side-to-side directions.

Figure 8:
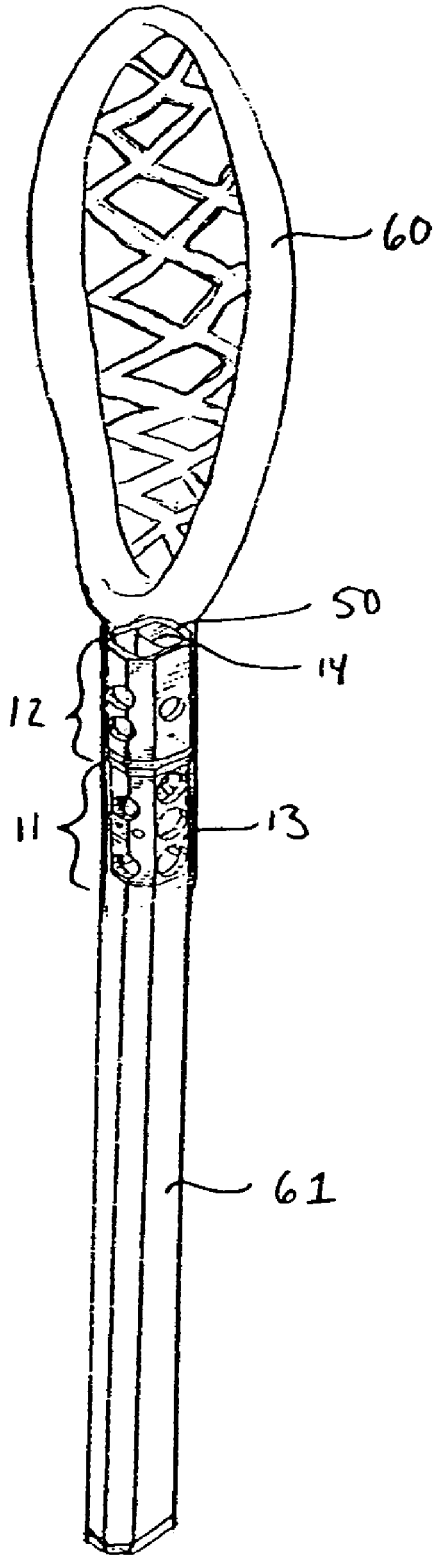
FIG. 8 is a partial side view of a lacrosse stick having a cut-away region showing the articulation mechanism in the rest position in accordance with an embodiment of the present invention.
Figure 9A:
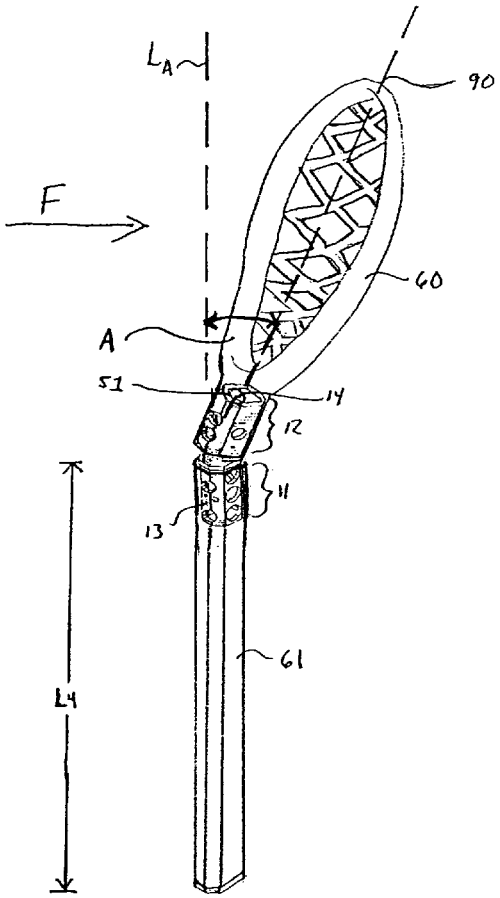
FIG. 9A is a partial side view of a lacrosse stick having a cut-away region showing the articulation mechanism in a flexed position in a first direction in accordance with an embodiment of the present invention.
Figure 9B:
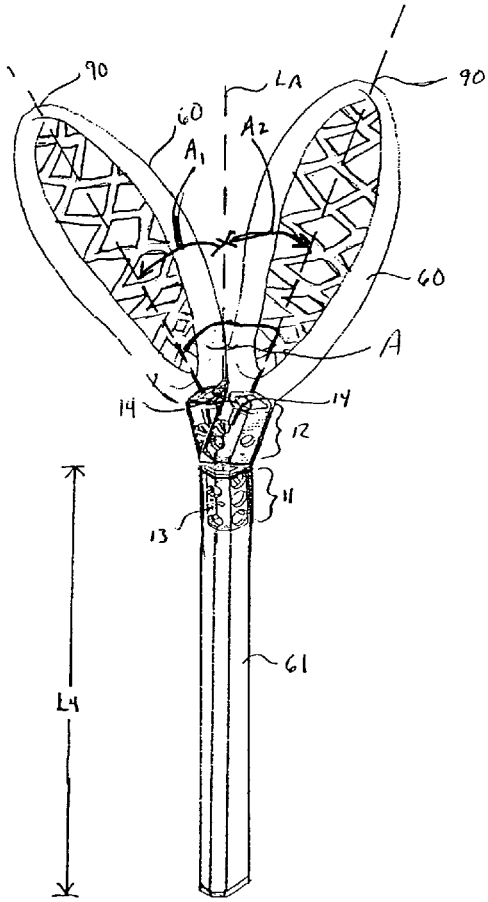
FIG. 9B is a partial side view of a lacrosse stick having a cut-away region showing the articulation mechanism in a flexed position in a second direction in accordance with an embodiment of the present invention.

FIG. 8 shows a lacrosse stick in the rest position, where the extended portion 14 of first element 11 is positioned at a first location 50 in the interior 16 of the second element 12. FIGS. 9A and 9B show a lacrosse stick in the flexed position, where the extended portion 14 of the first element 11 is positioned at a second location 51 that is different from the first location 50 within the interior 16 of the second element 12. Extended portion 14 can pivot about fastener 19 from a rest position to a flexed position.

In this embodiment, the extended portion 14 contacts a first wall 52 of the interior 16 of the second element 12 in the rest position, and the extended portion 14 contacts a second wall 53 of the interior 16 of the second element 12 in the flexed position. In another embodiment, the extended portion 14 is positioned within the interior 16 of the second element 12 without touching any interior wall (such as 52 or 53) of the second element 12 in the rest position, and the extended portion contacts a wall (such as 52 or 53) of the interior 16 of the second element 12 in the flexed position.

When a force F is applied to the articulation mechanism 10 in a direction that is about perpendicular to the longitudinal axis $L_A$ corresponding to the length L1 of the second element 12, or the length L2 and L3 of the first element 11, the engaged articulation mechanism 10 will hinge or flex about fastener 72. For example, as shown in FIGS. 9A and 9B, when a force F is applied to the head portion 60 of the lacrosse stick housing the second element 12 of the articulation mechanism 10, the head portion 60 will be offset with respect to the handle portion 61. In one embodiment, as shown in FIG. 9A, when a force F is applied to head portion 60, the head portion 60 is displaced from the longitudinal axis running along the length L4 of the handle portion 61 in a single direction by a displaced by a displacement angle A of from about 1 degree to about 60 degrees.

The displacement angle A is measured between the longitudinal axis corresponding to the center of the center of the handle portion 61 and the tip 90 of the head portion 60. The displacement angle A determines the displacement of a ball with respect to the plane of the handle portion 61. As shown in FIG. 9B, when a force F is applied to head portion 60, the head portion 60 can be displaced from the longitudinal axis in two directions, i.e., a forward direction and a backwards direction, by first and second displacement angles $A_1$ and $A_2$, respectively. Angles $A_1$ and $A_2$ may be the same or different.

The displacement angle A, $A_1$ or $A_2$ is typically from about 1 degree to about 60 degrees. For example, the displacement angle may be from about 1 degree to about 30 degrees. In yet another embodiment, the displacement angle may be from about 1 degree to about 10 degrees, such as from about 2 degree to about 5 degrees. As shown in FIG. 9B, the head portion can be displaced from the longitudinal axis by a displacement angle in either a forwards or backwards direction (or side to side depending on configuration). Force F can also be applied to the head portion by either catching or throwing a ball.

Figure 10:
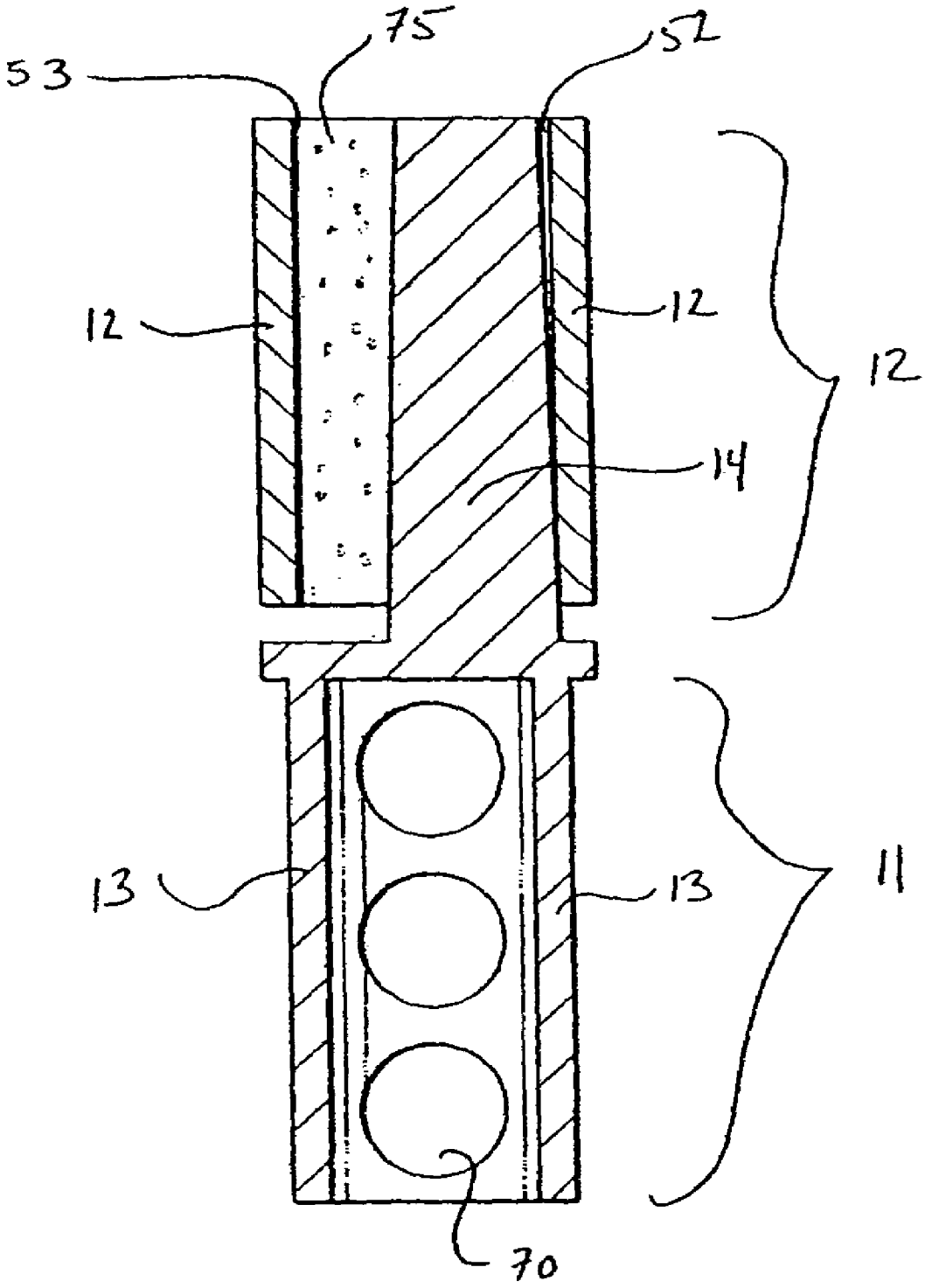
FIG. 10 is cut-away view diagram of the articulation mechanism having a foam dampening material in accordance with an embodiment of the present invention.
Figure 11:
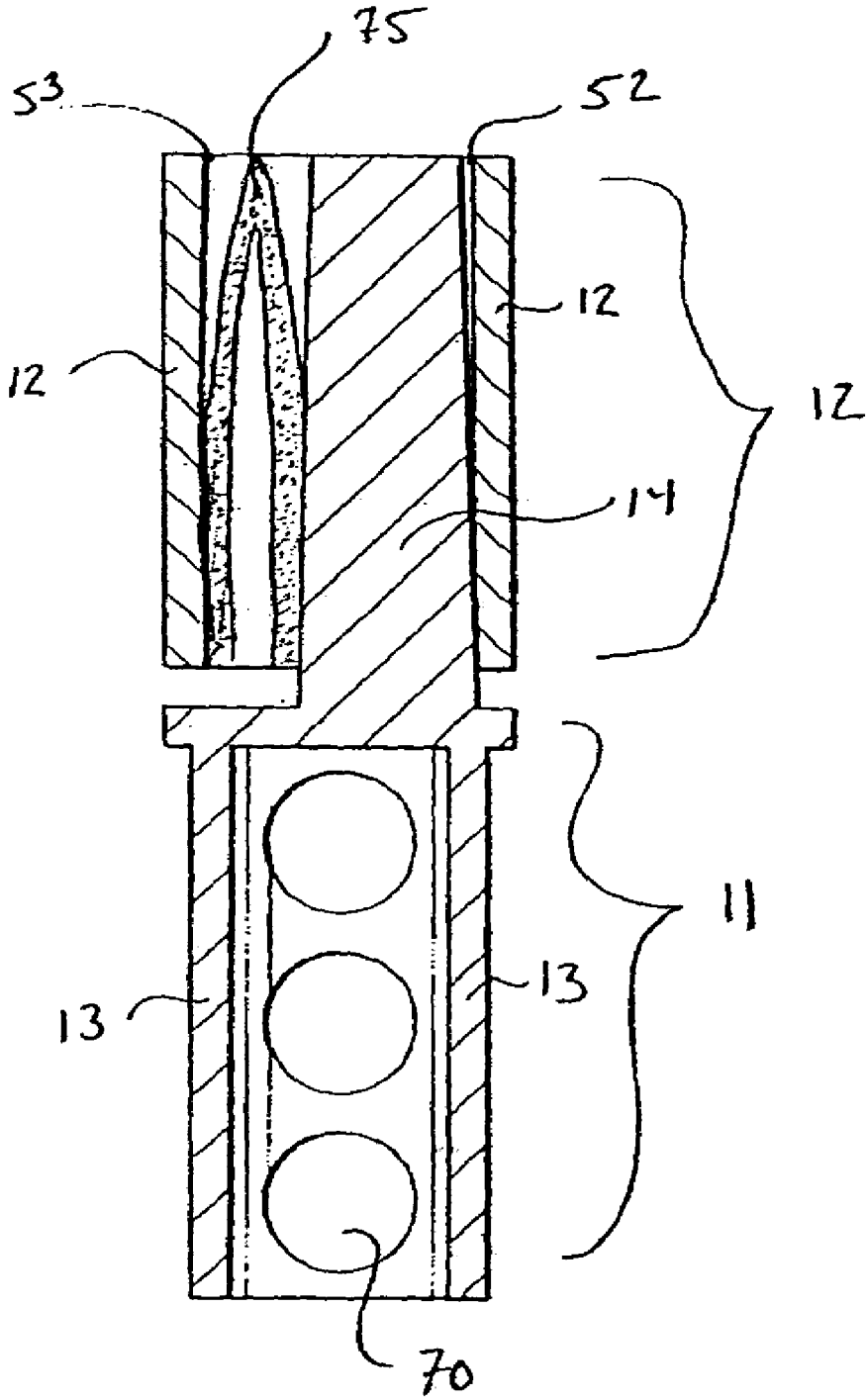
FIG. 11 is a cut-away view diagram of the articulation mechanism having a spring dampening material in accordance with an embodiment of the present invention.
Figure 12:
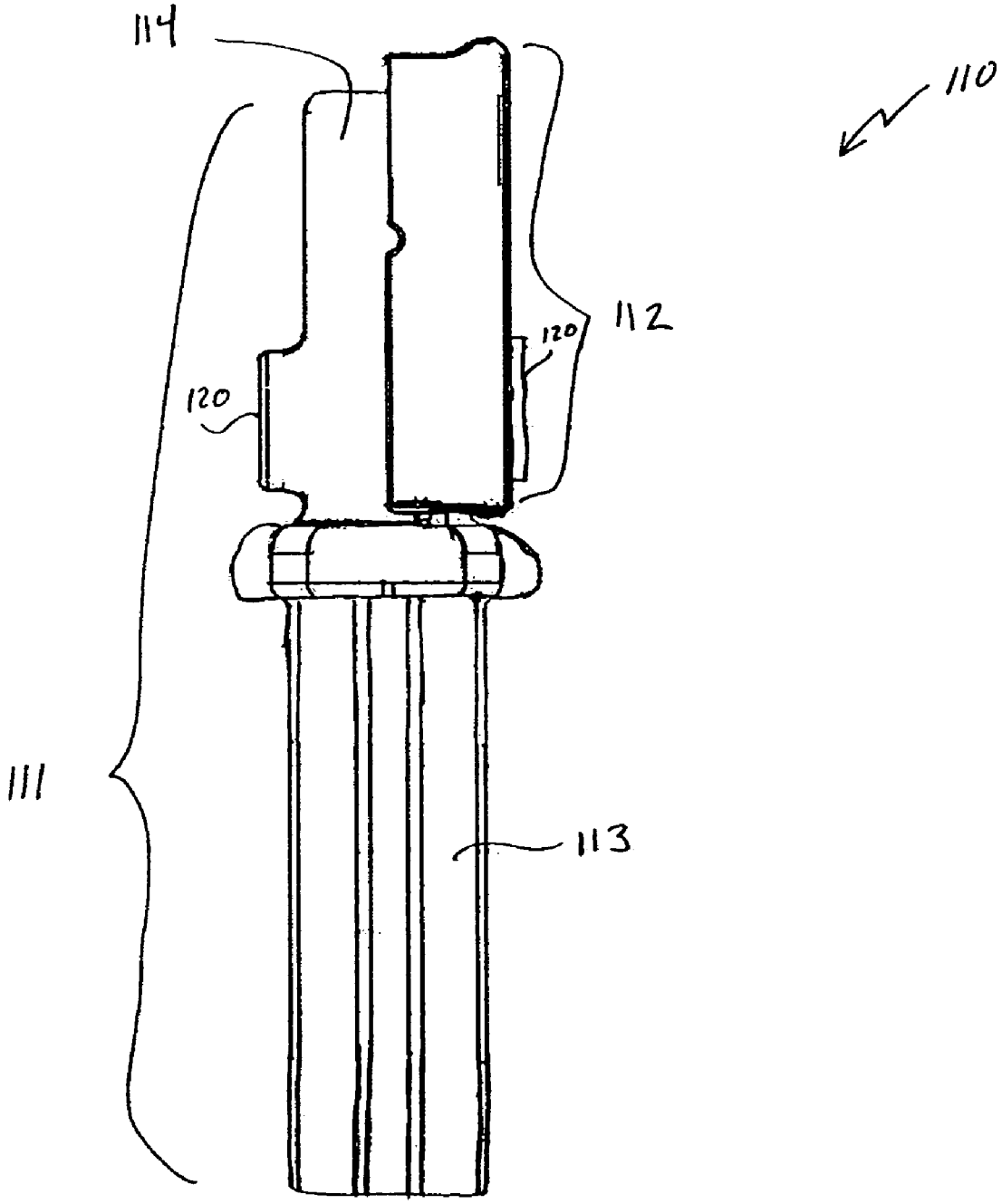
FIG. 12 is a side view of an articulation mechanism having projections on the sides of the extended portion and showing one-half of the second element in accordance with an embodiment of the present invention.
Figure 13:
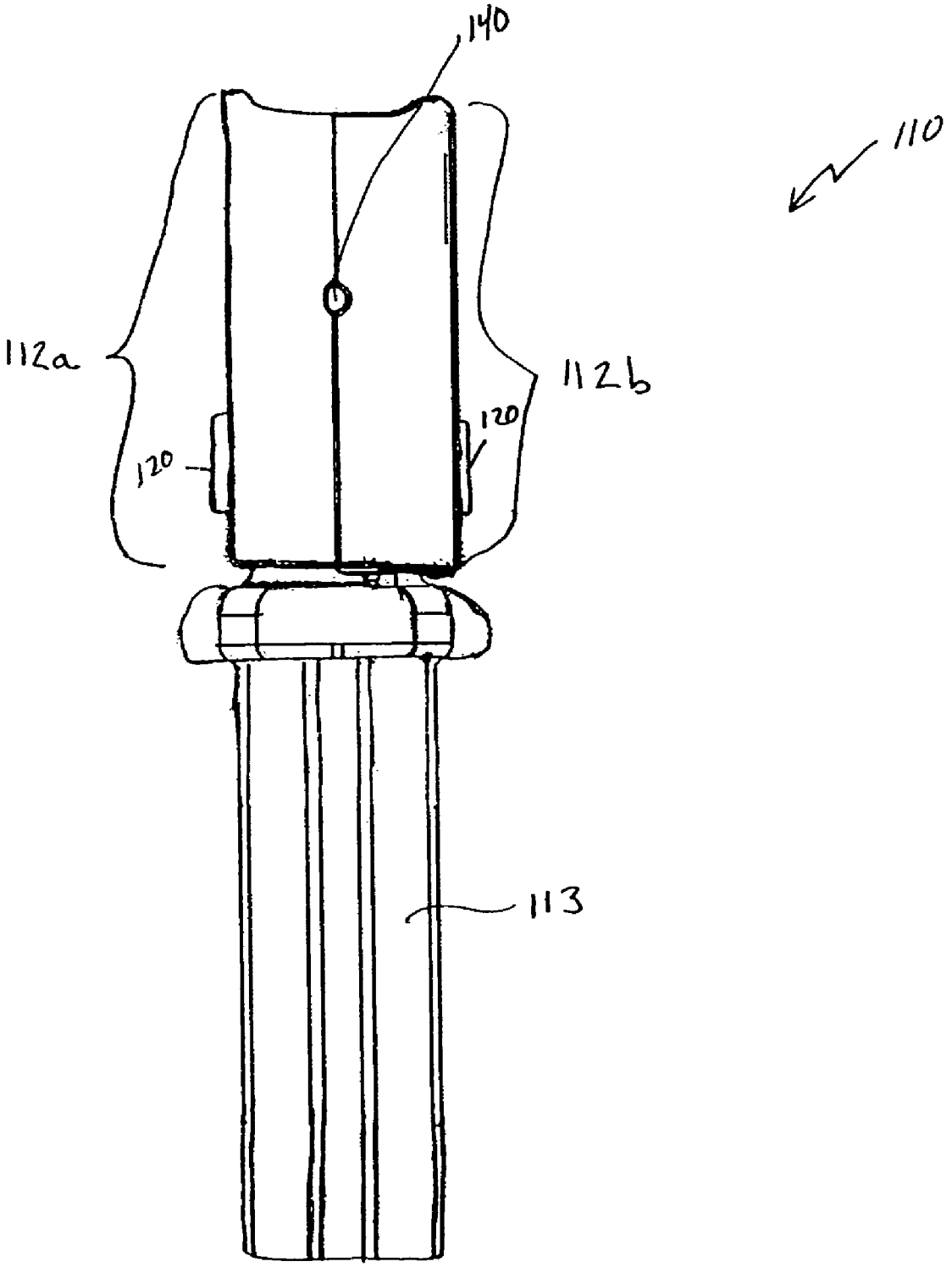
FIG. 13 is a side view of an articulation mechanism having projections on the sides of the extended portion and showing both halves of the second element in accordance with an embodiment of the present invention.
Figure 14:
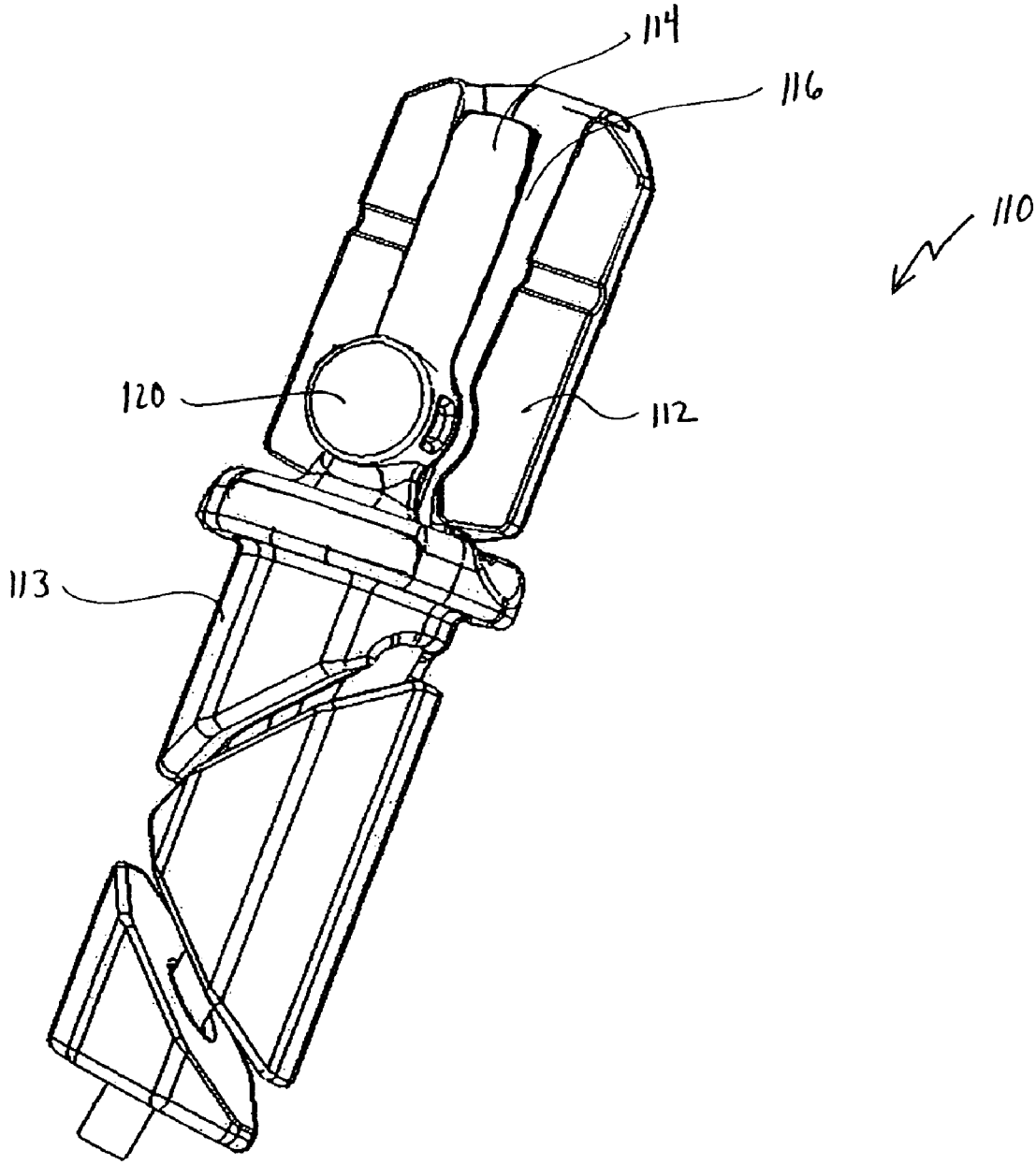
FIG. 14 is a partial side view of an articulation mechanism having projections on the sides of the extended portion and showing one-half of the second element in accordance with an embodiment of the present invention.
Figure 15:
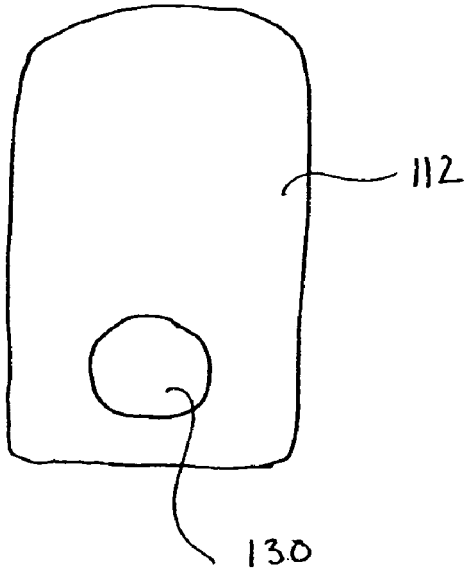
FIG. 15 is a side view of the second element in accordance with an embodiment of the present invention.

As shown in FIG. 10, a resistive material 75, such as a polymeric material having at least some elasticity, can be inserted into the interior 16 of the second element 12 to dampen the displacement of head portion 60 with respect to handle portion 61 when a force F is applied to the head portion 60 in a direction that is about perpendicular to the longitudinal axis of the second element 12 or the longitudinal axis of the first element 11. In this embodiment, extended portion 14 is inserted into second element 12 comprising the resistive material 75. Resistive material 75 can retard how rapidly the extended portion 14 moves from a rest position to a flexed position and can dampen the displacement angle. As shown in FIG. 11, a resistive material 75, can comprise a polymeric foam, a polyurethane bushing, a coiled spring, a living hinge or a metal or polymeric composition having at least some elasticity, that is inserted into second element 12 to retard how rapidly the extended portion 14 moves from a rest position to a flexed position and can also dampen the displacement angle.

In another embodiment as shown in FIGS. 12-15, the articulation mechanism 110 comprises a first portion 111, having a base portion 113 and an extended portion 114. Extended portion 114 comprises projections 120 that extend perpendicularly from the longitudinal axis running along the length of the extended portion 114. Articulation mechanism 110 also comprises a second element 112, having at least two pieces 112*a* and 112*b*. Each half of second element 112 comprises a hole 130 that is sized to allow a projection 120 to extend through second element 112. The halves of the second element 112*a* and 112*b* can be fitted together to surround the extended portion 114 of the first element 111. Second element 112 has an interior 116 which is sized to allow extended portion 114 to move from a first position to a second position as is described herein. Accordingly, the extended portion 114 can be moved from a rest position to a flexed position as also described herein. Each half of the second element 112*a* and 112*b* can comprise a set hole 140. In another embodiment, each half of the second element 112*a* and 112*b* can comprise one half of a set hole 140. A fastener, such as a setscrew, bolt, rivet, pin or other fastening device, can be inserted into the set hole 140 so that each half of the second element 112*a* and 112*b* are connected together. In one embodiment, once the articulation mechanism 110 is assembled such that the second element 112 surrounds the extended portion 114, the first element end of articulation mechanism 110 can be inserted into the handle portion 61 and the second element end can be inserted into the head portion 60 and a fastener can be inserted through the head portion 60 and set hole 140 to fasten the second element end and the head portion 60 together. The action of tightening the fastener can expand the second element 112 within the head portion 60 such that second element 112 and head portion 60 are tightly fastened together. In another embodiment, the first element end can be inserted into the head portion 60 and the second element end can be inserted into the handle portion 61 and a fastener can be inserted through the handle portion 61 and set hole 140 to fasten the second element end and the handle portion 61 together.

Figure 16:
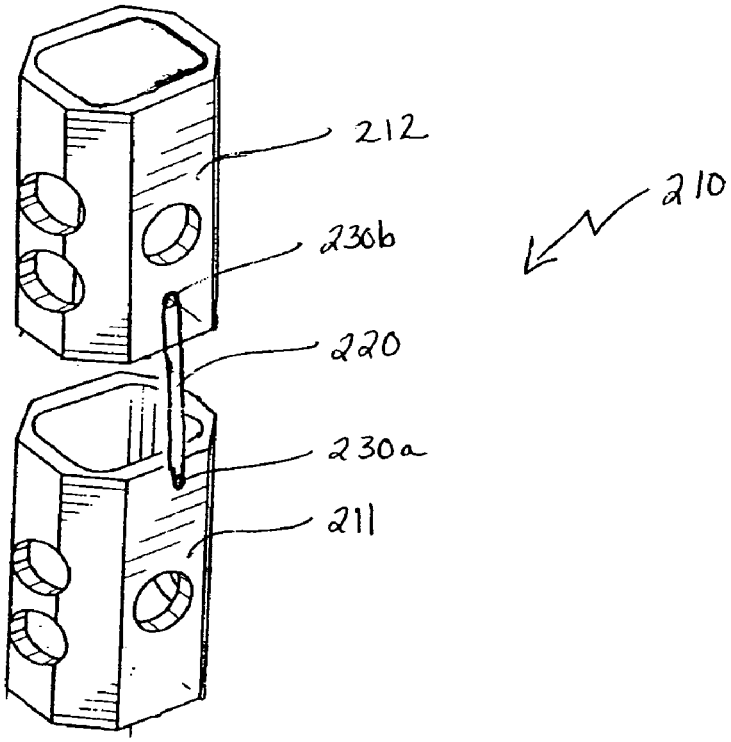
FIG. 16 is a diagram of an articulation mechanism having a move bar in the rest position in accordance with an embodiment of the present invention.
Figure 17:
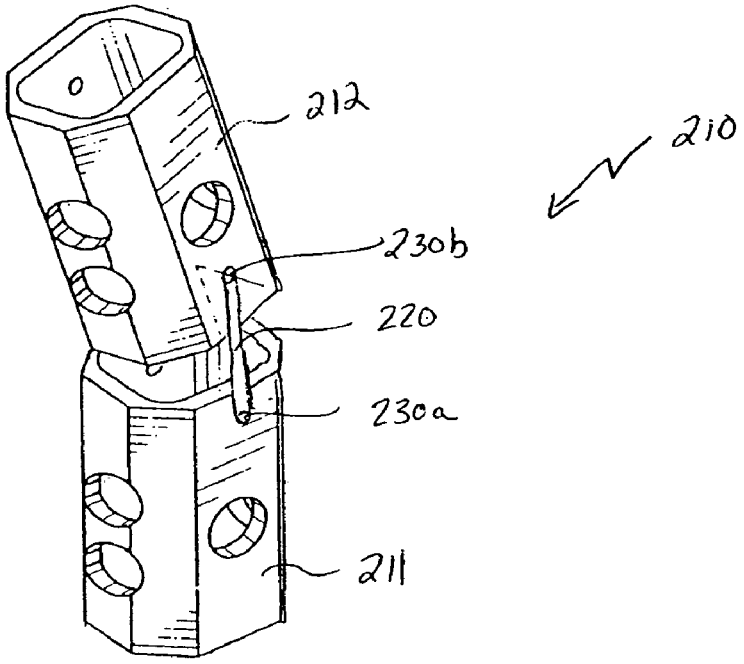
FIG. 17 is a diagram of an articulation mechanism having a move bar in the flexed position in accordance with an embodiment of the present invention.
Figure 18:
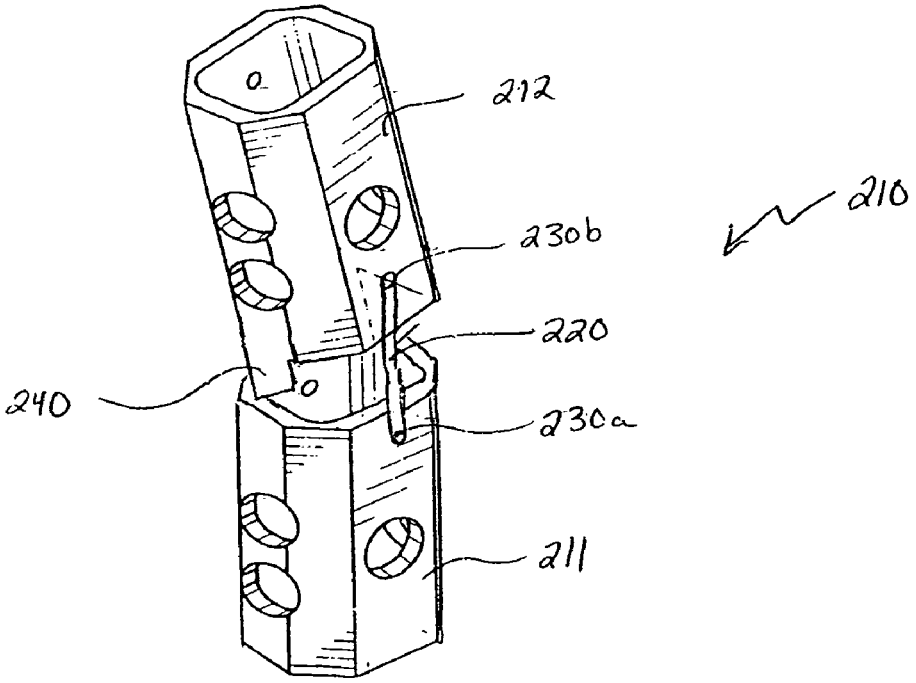
FIG. 18 is a diagram of an articulation mechanism having an extended area for contacting the first element in the flexed position in accordance with an embodiment of the present invention.

In another embodiment, as shown in FIGS. 16 and 17, the articulation mechanism 210 comprises a first element 211 and second element 212 which are moveably fastened together by a move bar 220 comprising a fastening element 230*a* connected to the first element 211 and a fastening element 230*b* connected to the second element 212. Fastening element 230 allows the first element 211 and the second element 212 to rotate around the fastening element 230. Fastening element 230 can comprise pivoting pins, bolts, rivets, screws, rods and the like. FIG. 16 shows the articulation mechanism 210 in a rest position and FIG. 17 shows the articulation mechanism 210 in a flexed position. In one embodiment, second element 212 is free to tilt with respect to first element 211 such that second element 212 can move from a rest position to a flexed position in which a portion of the second element 212 contacts the first element 211. In another embodiment, as shown in FIG. 18, second element 212 can comprise an extended area 240 which can contact the first element 211 in the flexed position.

Figure 19:
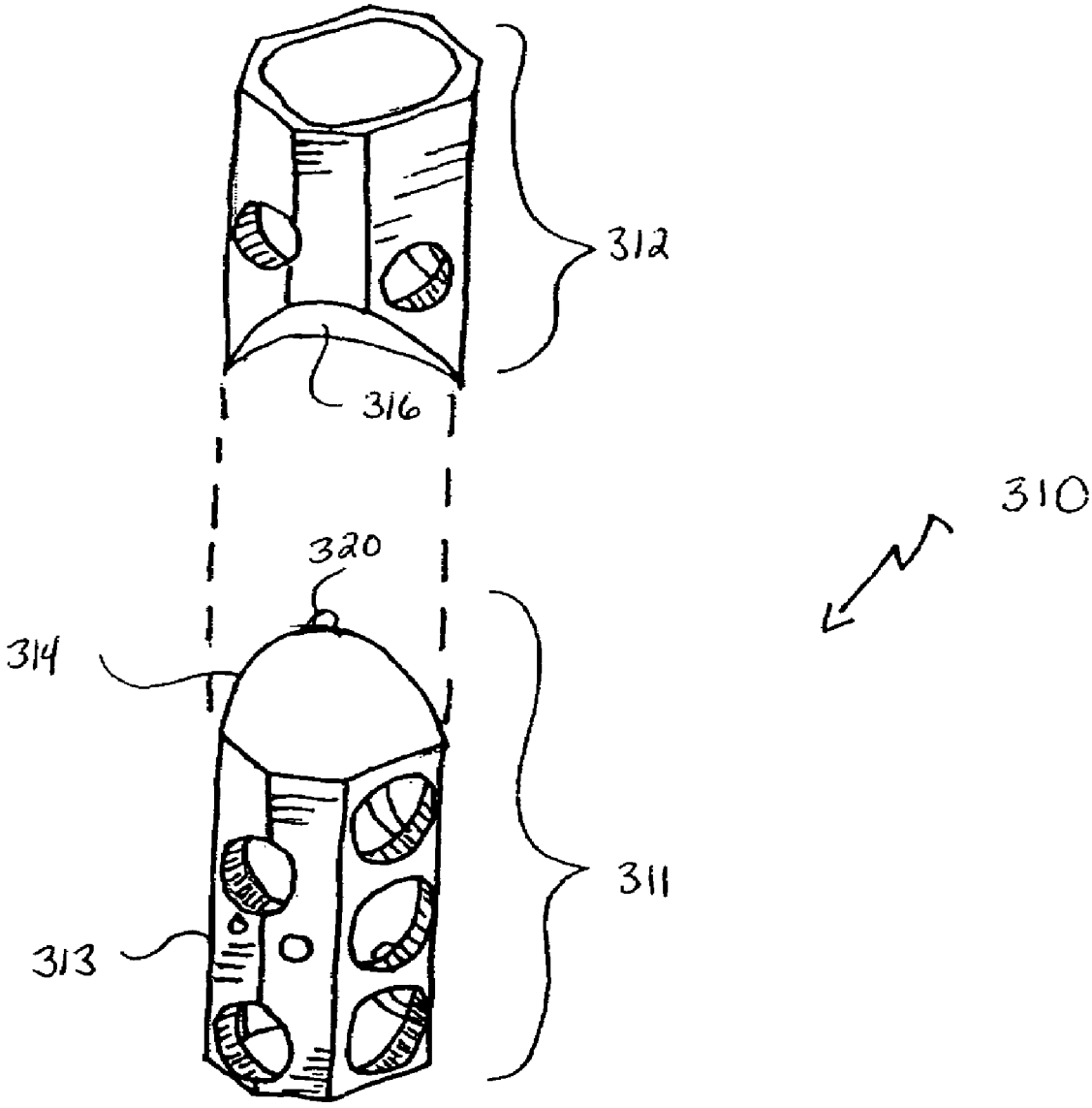
FIG. 19 is a diagram of an articulation mechanism having a ball and socket configuration in accordance with an embodiment of the present invention.

In another embodiment, the articulation mechanism 310 can comprise a ball and socket type assembly, thereby allowing articulation in multiple directions, including the fore-and-aft direction as well as side-to-side directions between a rest position and a flexed position. As shown in FIG. 19, first element 311 comprises a base portion 313 and an extended portion 314. The extended portion 314 comprises a domed structure or ball portion that engages the second portion 312. Second portion 312 comprises an interior 316 having a recessed socket area sized to receive the extended portion 314 of the first element 311. The extended portion 314 and the interior 316 of the second portion 312 can be combined by any conventional ball and socket means such as a knob connection 320 or a recessed groove connection extending along the periphery of the extended portion 314 with a protruding ridge extending along the interior 316 of the second element 312 wherein the groove and ridge are interlocking. As described above, the first element 311 can be housed within the handle portion 61 and the second element 312 can be housed within the head portion 60 of a lacrosse stick. In another embodiment, the first element 311 can be housed within the head portion 60 and the second element 312 can be housed within the handle portion 61.

Figure 20:
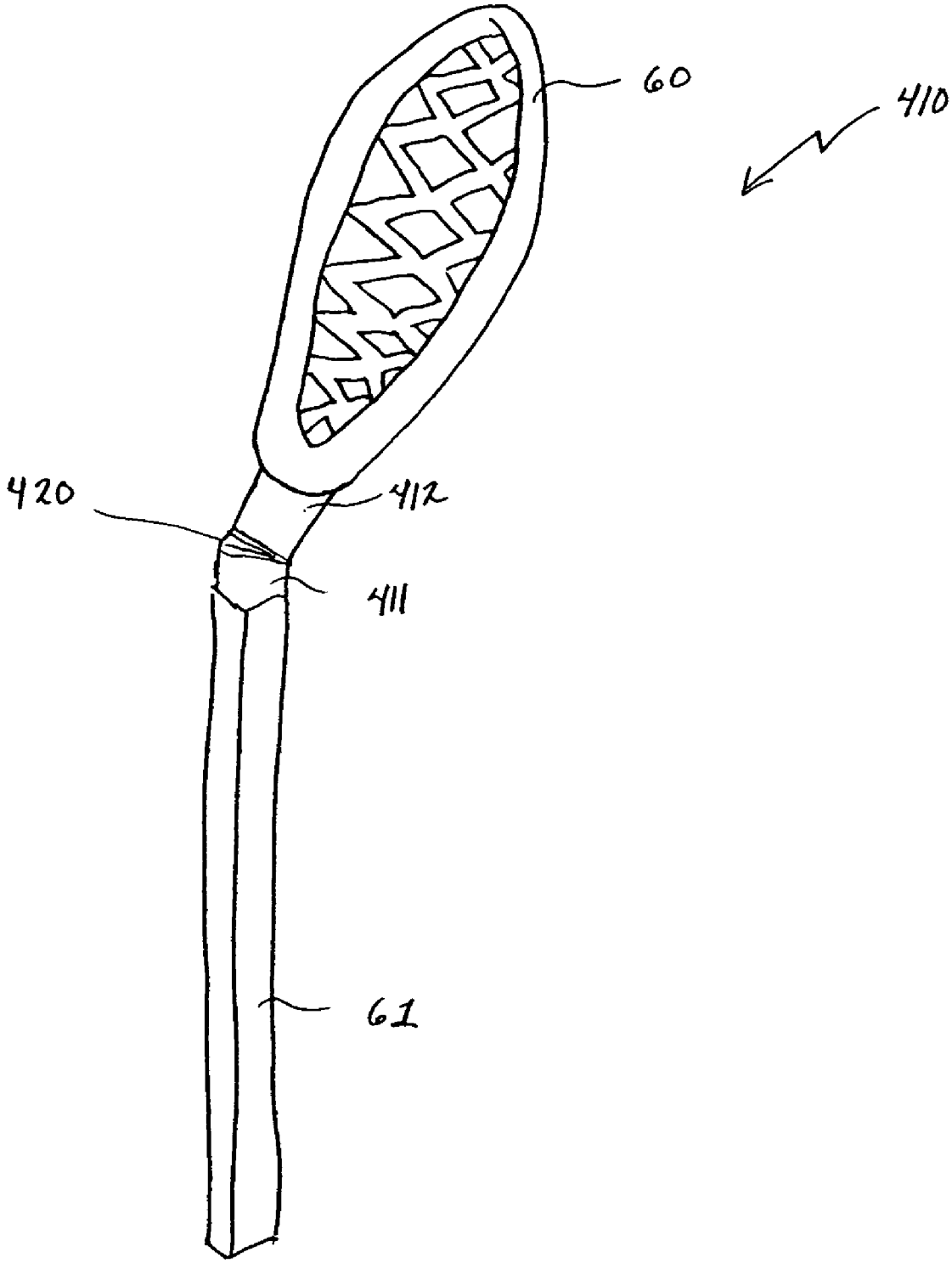
FIG. 20 is a diagram of an articulation mechanism having a living hinge configuration in accordance with an embodiment of the present invention.

In another embodiment, the articulation mechanism 410 as shown in FIG. 20 can comprise a living hinge having a first element 411 and a second element 412 that are integrally connected. In this embodiment, the first element 411 and the second element 412 comprise a single elastomeric material. In one embodiment, the elastomeric material may be ridged or corrugated. The first element 411 can be housed within the handle portion 61 of a lacrosse stick and the second element 412 can be housed within the head portion 60. In another embodiment, the first element 411 can be housed within the head portion 60 of a lacrosse stick and the second element 412 can be housed within the handle portion 61.

Figure 21:
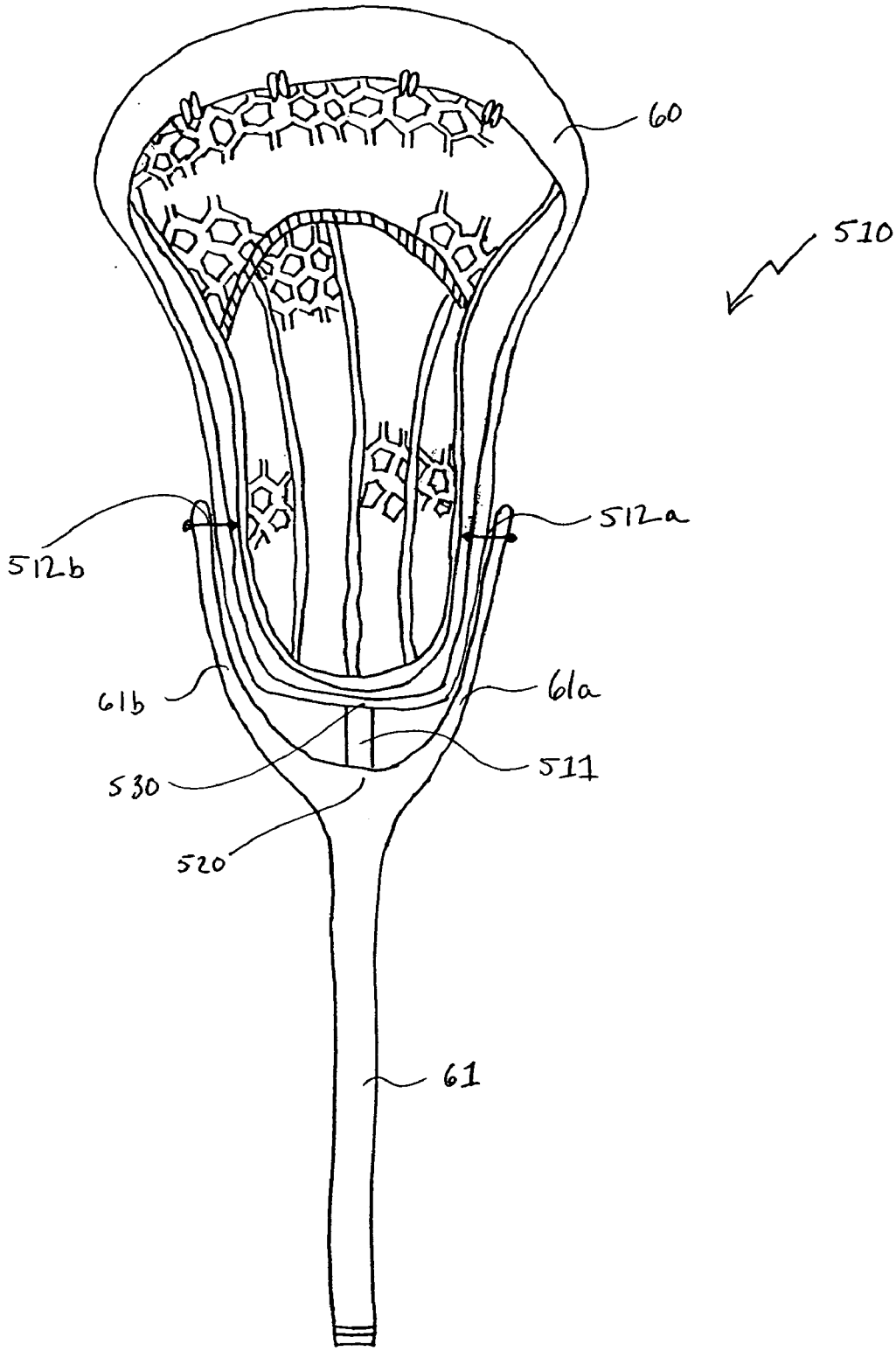
FIG. 21 is a diagram of a lacrosse stick having an articulation mechanism having a Y-shaped handle portion and a pivoting head portion in accordance with an embodiment of the present invention.
Figure 22:
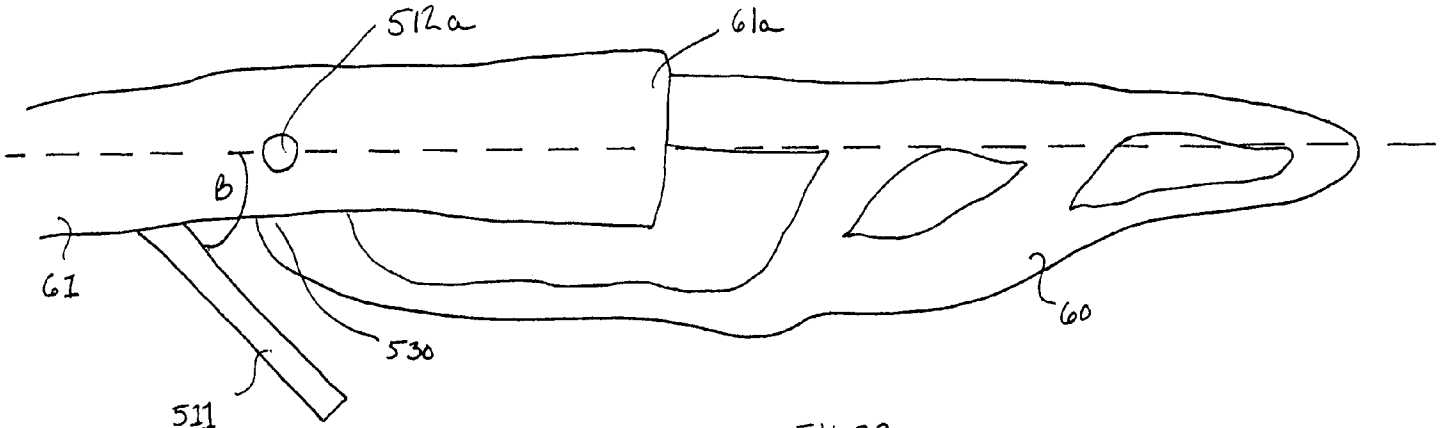
FIG. 22 is a partial side view of a lacrosse stick having the articulation mechanism of FIG. 21 in the rest position in accordance with an embodiment of the present invention.
Figure 23:
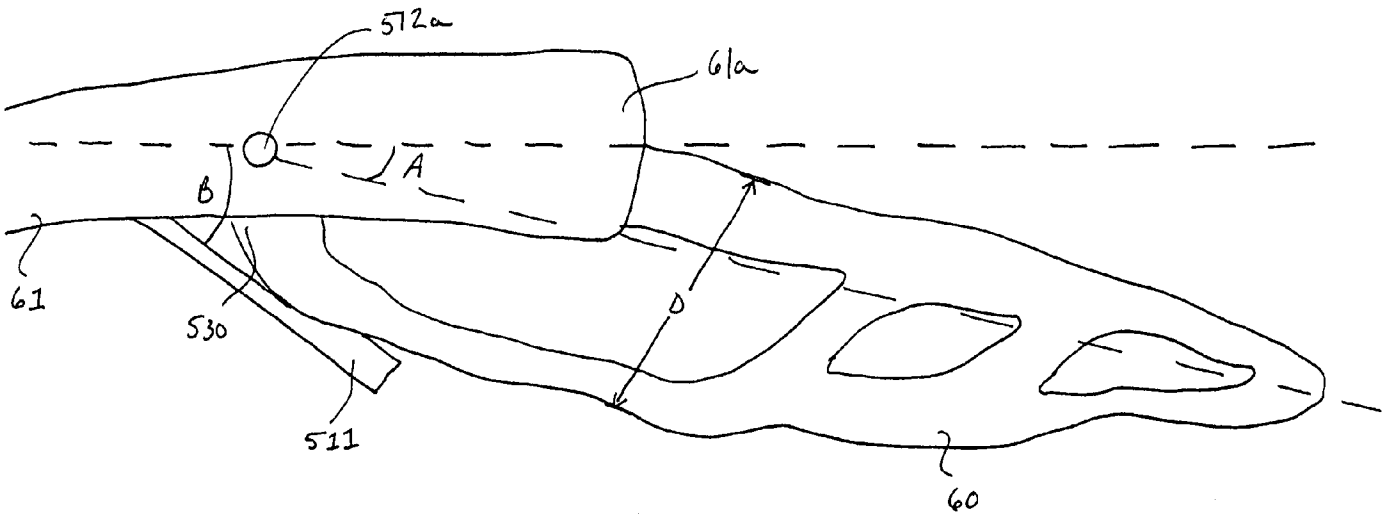
FIG. 23 is a partial side view of a lacrosse stick having the articulation mechanism of FIG. 21 in the flexed position in accordance with an embodiment of the present invention.

In yet another embodiment, the articulation mechanism 510 as shown in FIGS. 21-23, comprises a first element 511, a second element 512 and a handle portion 61 having a Y-shaped area 61*a* and 61*b* corresponding to the outer periphery of a head portion 60. As shown on the lacrosse stick of FIG. 21, second element 512 is a fastening element that can extend between the head portion 60 and the Y-shaped area 61*a* and/or 61*b* of the handle portion 61. Second element 512 can be any suitable fastener that allows the head portion 60 to pivot or rotate with respect to the handle portion 61. Second element 512 can comprise connector rods, pins, bolts, rivets, screws and the like. In another embodiment, a first second element 512*a* connects the head portion 60 to the Y-shaped area 61*a* of the handle portion 61 and a second second element 512*b* connects the head portion 60 to the Y-shaped area 61*b* of the handle portion 61.

A first element 511 having a length greater than the distance from the yoke 520 of the Y-shaped area of the handle portion 61 to the base of the head portion 530 can also be disposed on the handle portion 61 to restrict the flexure of the head portion 60 with respect to the handle portion 61. In the flexed position, first element 511 can contact the head portion 60 to restrict the flexure. In one embodiment, the first element 511 is attached to the handle portion 61 at an angle B. Angle B can be from about 1 degree to about 60 degrees. In another embodiment, angle B is from about 1 degree to about 45 degrees. In yet another embodiment, as shown in FIG. 23, angle B is determined by the depth D of the head portion 60 such that displacement angle A is from about 1 degree to about 60 degrees, preferably from about 2 degrees to about 10 degrees. In another embodiment, the first element 511 can be disposed at any location along the handle portion 61 such that first element 511 can restrict the flexure of the head portion 60 by contacting the head portion 60 in the flexed position.

Figure 24A:
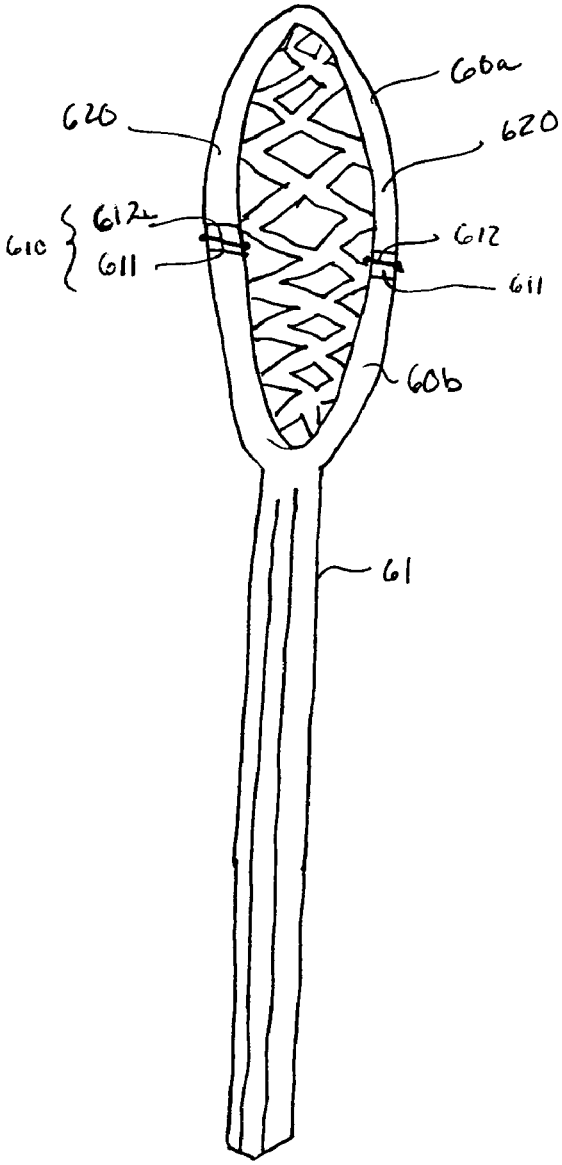
FIG. 24A is a partial side view of a lacrosse stick showing the articulation mechanism in a rest position in accordance with an embodiment of the present invention.
Figure 24B:
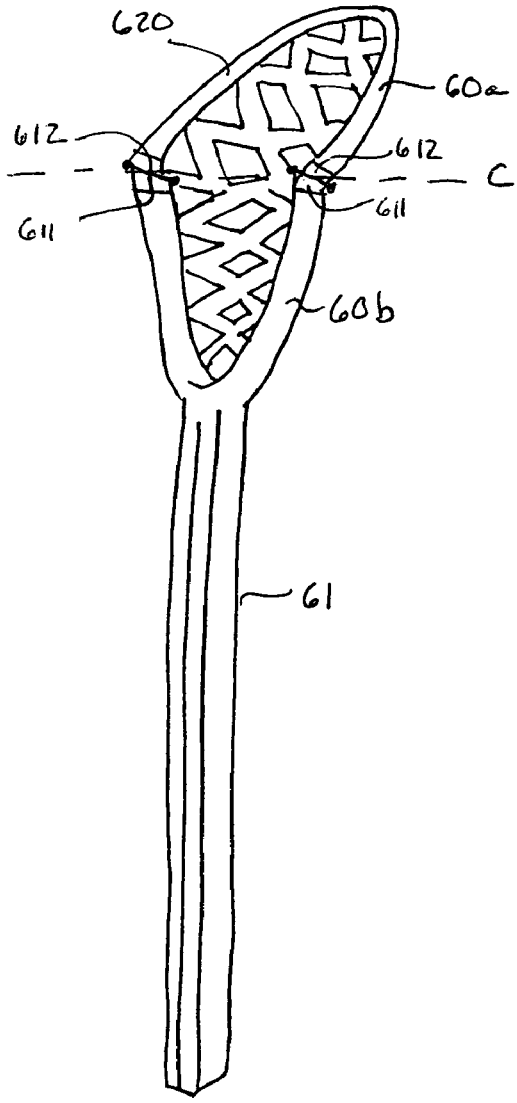
FIG. 24B is a partial side view of a lacrosse stick having the articulation mechanism of FIG. 24A in the flexed position in accordance with an embodiment of the present invention.

As shown in FIGS. 24A and 24B, articulation mechanism 610 can also be housed within the side walls 620 of the head portion 60 of the lacrosse stick. FIG. 24A shows an embodiment of the lacrosse stick of the present invention in the rest position. FIG. 24B shows the same lacrosse stick in the flexed position. As shown in FIG. 24B, the articulation mechanism 610 provides an articulation of a head portion 60*a* with respect to head portion 60*b* along the line C. First element 611 can be housed in head portion 60*a* and second element 612 can be housed in head portion 60*b*. In another embodiment, first element 611 can be housed in head portion 60*b* and second element 612 can be housed in head portion 60*a*. Side walls 620 can integrally comprise an articulation mechanism 610 having greater flexibility than other sections of the side walls 620. In this embodiment, side walls 620 may comprise a rigid polymeric material and an articulation mechanism 610 comprising a flexible polymeric composition.

Figure 25:
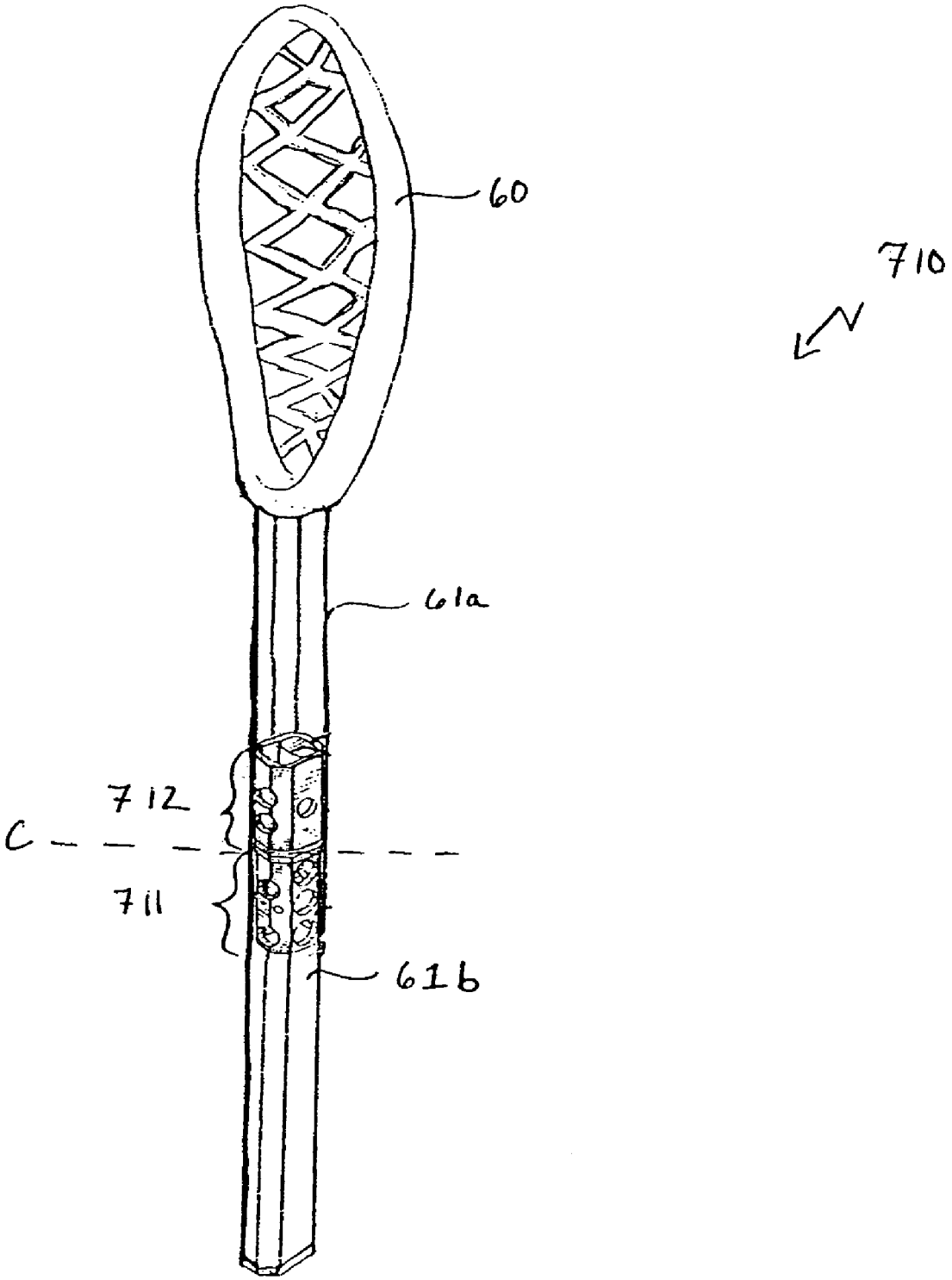
FIG. 25 is a diagram of a lacrosse stick having an articulation mechanism housed entirely within the handle portion in accordance with an embodiment of the present invention.

In another embodiment as shown in FIG. 25, the articulation mechanism 710 can be housed entirely within the handle portion 61 of the lacrosse stick. In this embodiment, the handle portion 61 includes both the second element 712 and the first element 711 disposed within the respective handle portions 61*a* and 61*b*. As shown in FIG. 25, the articulation mechanism 710 provides an articulation of handle portion 61*a* with respect to handle portion 61*b* along the line C. Second element 712 can be housed in handle portion 61*a* and first element 711 can be housed in handle portion 61*b*. In another embodiment, second element 712 can be housed in handle portion 61*b* and first element 711 can be housed in handle portion 61*a*.

The exterior surfaces of the first element 11, 111, 211,311, 411,511, 611 and/or 711 and the second element 12, 112, 212, 312, 412, 512, 612 and/or 712 can comprise any shape and surface characteristics that correspond to the interior of head portion 60 or handle portion 61 of a lacrosse stick. For example, the interior of some lacrosse sticks is an elongated octagonal shape, accordingly, the exterior surfaces of second element 12 and the first element 11 can comprise an elongated octagonal shape to allow for easy insertion within the head portion 60 and handle portion 61.

First element 11, 111, 211,311, 411,511, 611 and/or 711 and second element 12, 112, 212, 312, 412,512,612 and/or 712 can be made of any suitable material such as lightweight metal, polymeric compositions, graphite or wood. In one embodiment, the first element 11 and second element 12 are made of thin gauge metal extrusion of aluminum, steel, stainless steel and/or titanium. In another embodiment, the first element 11 and the second element 12 are made of a tough polymeric material such as fiber-reinforced composite plastic, high impact PVC, polyolefin polymer or high impact nylon. In another embodiment, the first element 11 and the second element 12 are made of a ceramic or composite material. Weight reducing sections 70 can be cut into the material comprising the first element 11 and the second element 12 to decrease the weight of the articulation mechanism 10, allowing for easier playability.

As described herein, the articulation mechanism 10 can be constructed to allow a rest position and a flexed position in a fore and/or aft direction. In another embodiment, the articulation mechanism 10, 110, 210, 310, 410,510, 610 and/or 710 can be constructed to allow a rest position and a flexed position in a leftward side and/or rightward side direction. In another embodiment, the articulation mechanism disclosed herein can be constructed to allow a rest position and a flexed position in multiple directions simultaneously.

Figure 26:
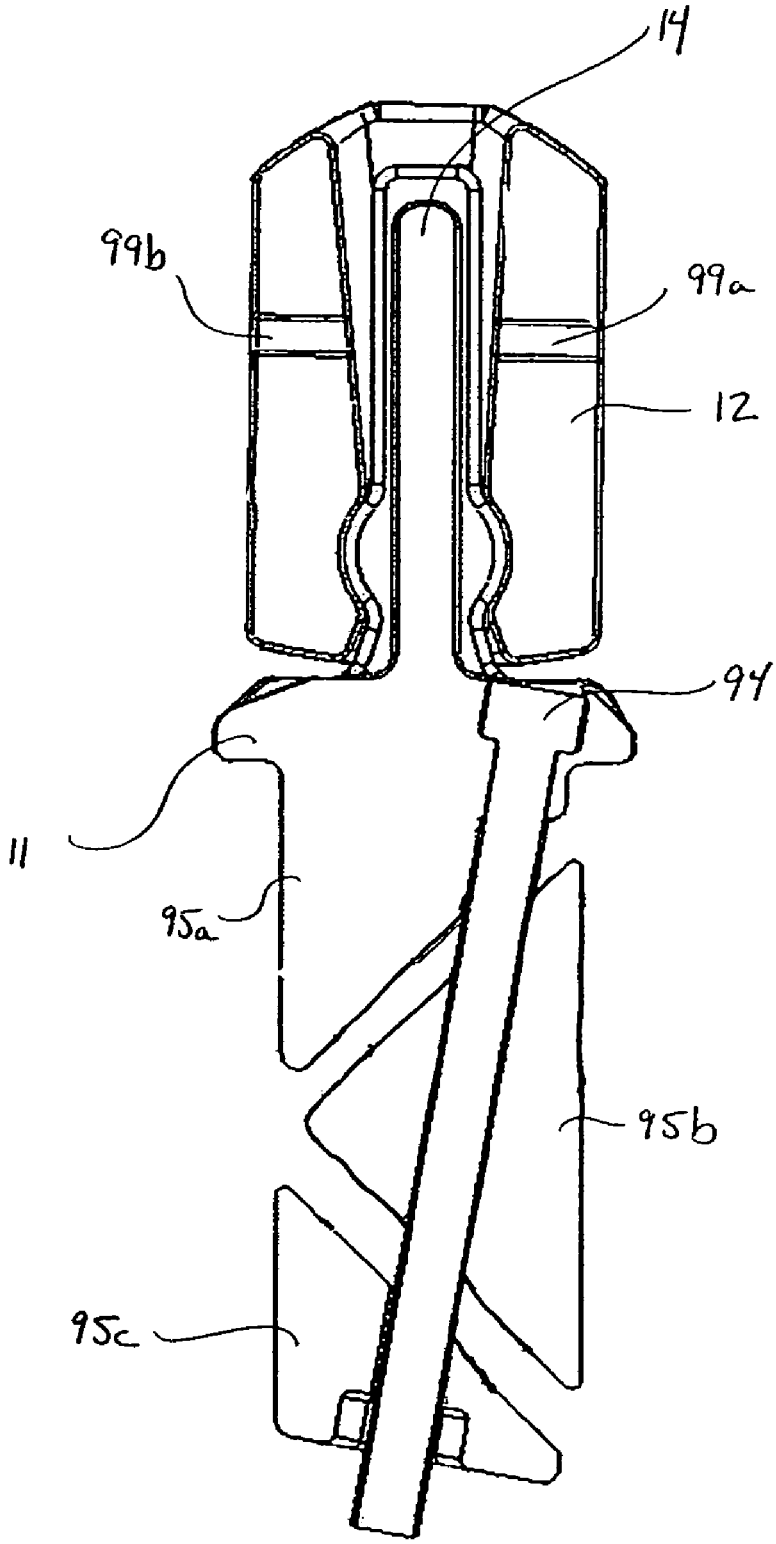
FIG. 26 is a cut away side view diagram of an articulation mechanism having a fastener and offset wedges in the loose position in accordance with an embodiment of the present invention.
Figure 27:
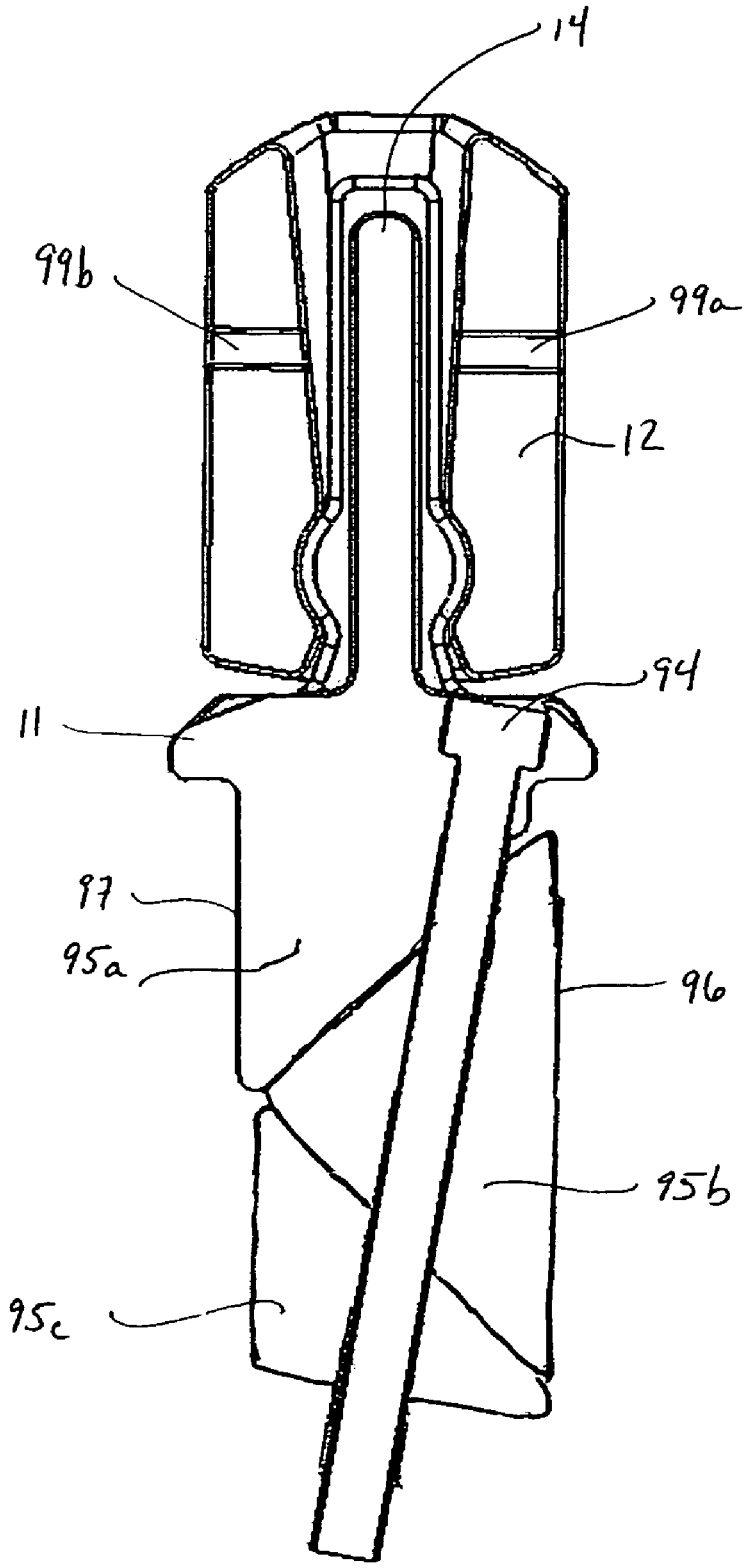
FIG. 27 is a cut away side view diagram of the articulation mechanism of FIG. 26 having a fastener and offset wedges in the tightened position in accordance with an embodiment of the present invention.

The articulation mechanism 10, 110, 210, 310, 410, 510, 610 and/or 710 of the present invention can be used to retrofit any existing lacrosse stick. Accordingly, a radially-expandable system can be used to tighten the fit between the articulation mechanism 10 and the interior of the handle portion 61 and the head portion 60. As shown in FIG. 26, a series of generally triangular wedges offset from center can be used to tighten the fit between the articulation mechanism and the interior of the handle portion 61. In this embodiment, a screw or other tightenable fastener 94 is thread through a plurality of wedges 95. Without substantially tightening the fastener, the articulation mechanism 10 and wedges 95 in the loose position as shown in FIG. 26 is disposed within the handle portion 61 of a lacrosse stick. When the fastener 94 is tightened, as shown in FIG. 27, the wedges 95 are pulled together. Due to the offset orientation of the wedges 95, the wedges 95 in the tightened position have a collective radial diameter that is greater than the diameter of any individual wedge 95 or the collective radial diameter in the loose position. As the fastener 94 is tightened, wedge 95*b* is drawn upwards to engage wedge 95*a*. Since wedge 95*b* is threaded off-center from wedge 95*a*, when wedges 95*a* and 95*b* are tightened, the diameter of the wedges 95 as measured from the outside edge 97 of wedge 95*a* to the outside edge 96 of wedge 95*b* is greater in the tightened position than in the loose position. This can also be true of wedge 95*c* in relation to wedge 95*b*. Wedges 95 can comprise any suitable material. In one embodiment, the wedges 95 are made from a lightweight polymeric material.

In one embodiment, wedges 95 and fastener 94 are connected to the first element 11 and inserted into the handle portion 61 of a lacrosse stick, however, the reverse configuration is also contemplated herein. Other material such as foam, spring loaded pads or screw driven pads can also be used to tighten the fit between the articulation mechanism 10 and the interior of the handle portion 61. In another embodiment, the second element 12 is inserted into the head portion 60 and fastened together by a setscrew 99, plurality of setscrews 99*a* and 99*b* or other suitable fastener.

Figure 28:
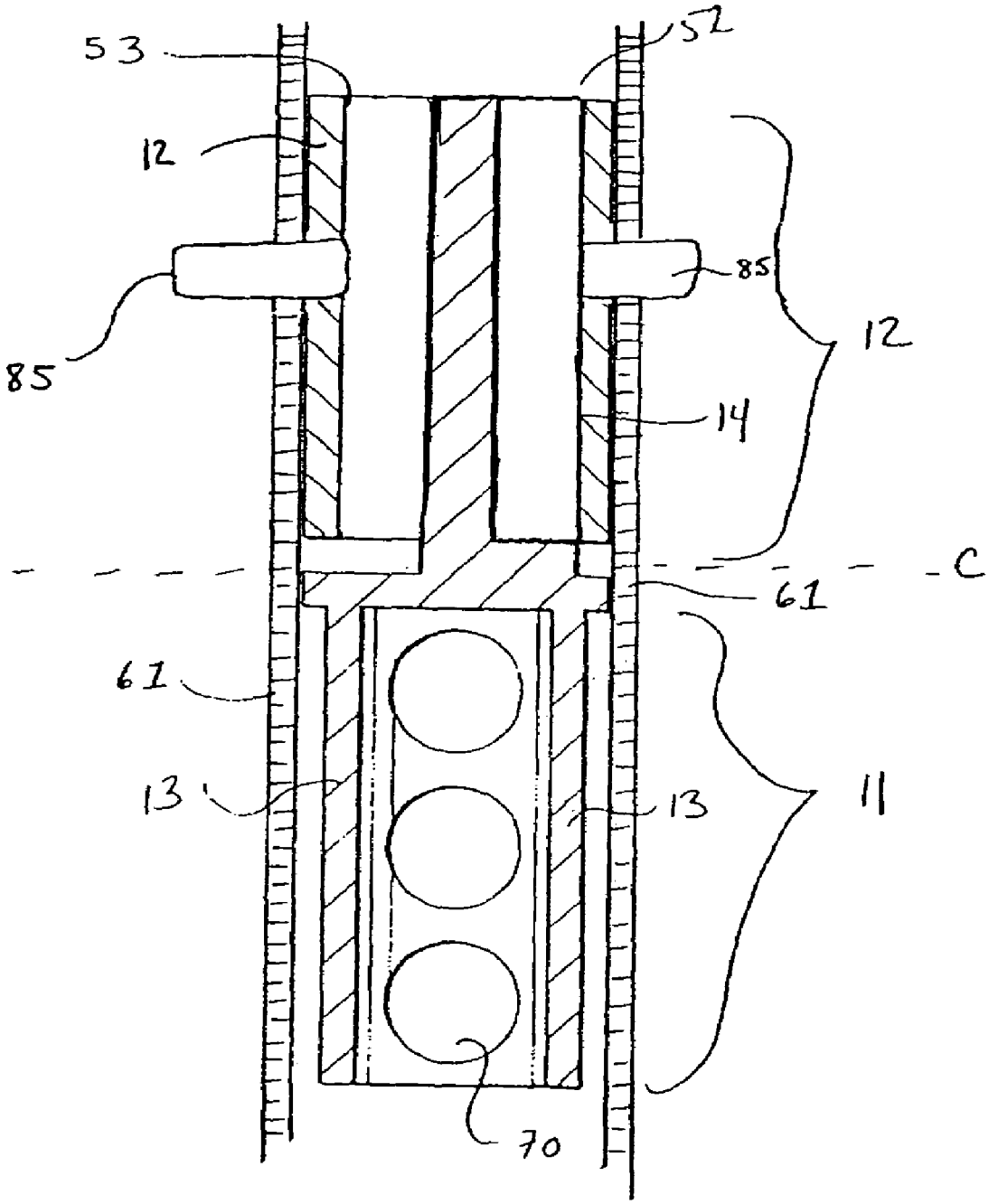
FIG. 28 is a cut-away view diagram of the handle portion housing an articulation mechanism having a locking feature in the rest position and unengaged position in accordance with an embodiment of the present invention.
Figure 29:
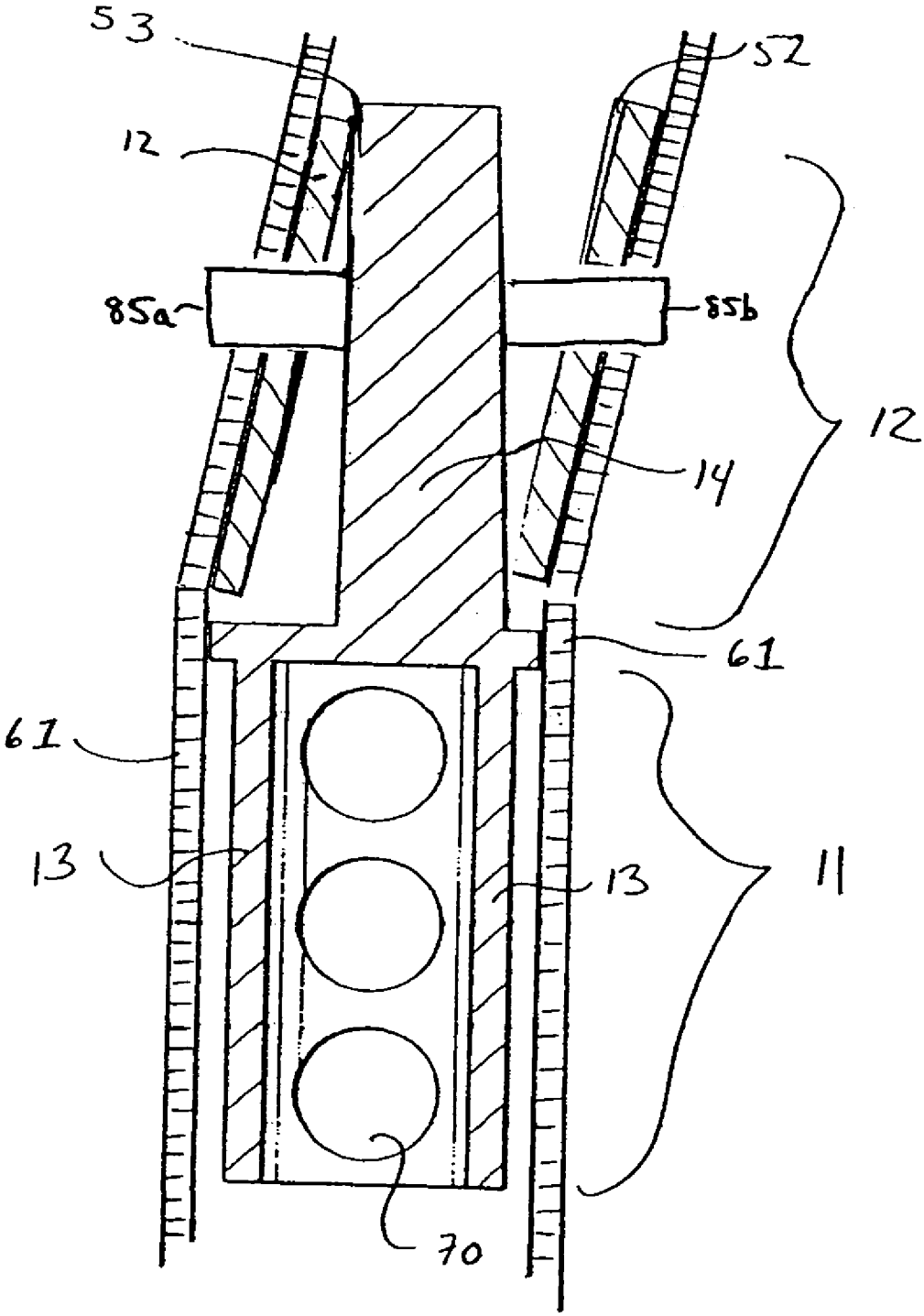
FIG. 29 is a cut-away view diagram of the handle portion housing the articulation mechanism of FIG. 28 having a locking feature in the flexed position and the engaged position in accordance with an embodiment of the present invention.

As shown in FIGS. 28 and 29, articulation mechanism 10, 110, 210, 310,410, 510, 610 and/or 710 may optionally comprise a locking feature 85. Locking feature 85 can be operable from the exterior of the handle portion of a lacrosse stick by the user to lock the angle of the head portion 60 with respect to the handle portion 61 or a first handle portion 61*a* with respect to a second handle portion 61*b*. In one embodiment, locking feature 85 is a push button mechanism. FIG. 28 shows the locking feature 85 in an unengaged position such that the extended portion 14 of the first element 11 is free to move from a rest position to a flexed position within the second element 12. FIG. 29 shows the locking feature 85 in the engaged position such that the extended portion 14 of the first element 11 is held tightly against the locking feature 85 in a fixed position. In another embodiment, multiple locking features 85*a* and 85*b* can be deployed to hold the extended portion 14 at a fixed location. In another embodiment, the action of throwing and/or catching a ball may also engage or disengage the locking feature 85. In yet another embodiment, the action of throwing and/or catching a ball may alter the displacement angle A of the head portion 60 with respect to the handle portion 61. Locking feature 85 can also be altered via a tool to adjust the displacement angle A of the head portion 60 with respect to the handle portion 61 in the flexed position.

A lacrosse stick of the present invention may also optionally include multiple articulation mechanisms 10, 110, 210, 310, 410, 510, 610 and/or 710 as disclosed herein.

Whereas particular embodiments of this invention have been described above for purposes of illustration, it will be evident to those skilled in the art that numerous variations of the details of the present invention may be made without departing from the invention as defined in the appended claims.

What is claimed is:

1. A lacrosse stick comprising:

a rigid lacrosse stick handle structured and arranged to be gripped by two hands of a lacrosse player;

a lacrosse head structured and arranged to receive a lacrosse ball connected to the lacrosse stick handle; and an articulation means for allowing articulation of at least a portion of the lacrosse head with respect to the lacrosse stick handle.

2. The lacrosse stick of claim 1, wherein the lacrosse head is connected to the lacrosse stick handle by the articulation mechanism.

3. The lacrosse stick of claim 1, wherein the articulation mechanism is located between an end of the lacrosse stick handle and a base of the lacrosse head.

4. The lacrosse stick of claim 1, wherein the articulation mechanism is contained within the lacrosse head and lacrosse stick handle.

5. The lacrosse stick of claim 1, wherein the lacrosse head is moveable from a longitudinal axis of the lacrosse stick handle to a displacement angle of up to about 60 degrees.

6. The lacrosse stick of claim 5, wherein the displacement angle is from about 1 degree to about 10 degrees.

7. The lacrosse stick of claim 5, wherein the displacement angle is from about 2 degrees to about 5 degrees.

8. The lacrosse stick of claim 1, wherein the lacrosse head is moveable from a longitudinal axis of the lacrosse stick handle to first and second displacement angles of up to about 60 degrees each.

9. The lacrosse stick of claim 8, wherein the first displacement angle and the second displacement angles are oriented in opposite directions from each other.

10. The lacrosse stick of claim 9, wherein the first and second displacement angles are the same.

11. The lacrosse stick of claim 9, wherein the first and second displacement angles are different.

12. The lacrosse stick of claim 1, wherein the lacrosse head is articulated in a direction in which a lacrosse ball would exit the lacrosse head.

13. The lacrosse stick of claim 1, wherein the articulation mechanism comprises:

a first element having an extended portion; and a second element having an interior that is sized to allow the first element to at least partially engage the interior and move from a first position to a second position within the interior.

14. The lacrosse stick of claim 13, wherein the first element and the second element are connected by a fastener that allows the first element to pivot or hinge with respect to the second element.

15. The lacrosse stick of claim 13, wherein the extended portion comprises at least one projection, the projection extending substantially perpendicular from a longitudinal axis of the extended portion, and the second element comprises at least two pieces structured and arranged to be fitted together over the at least one projection.

16. The lacrosse stick of claim 13, wherein the second element comprises a resistive material in the interior.

17. The lacrosse stick of claim 16, wherein the resistive material is a polymeric foam, a polyurethane bushing, a coiled spring, a living hinge or a metal or polymeric composition having at least some elasticity.

18. The lacrosse stick of claim 1, wherein the articulation mechanism comprises:

a first element;

a second element; and a move bar comprising at least one pivotable fastening element connected to the first element and second element.

19. The lacrosse stick of claim 1, wherein the articulation mechanism comprises a ball and socket assembly.

20. The lacrosse stick of claim 1, further comprising a radially-expandable system comprising a plurality of generally triangular wedges and a tightenable fastener disposed within the plurality of wedges, wherein the fastener is disposed within at least one wedge at a position that is off-center from at least one other wedge.

21. The lacrosse stick of claim 1, further comprising a locking mechanism for restricting the flexure of the lacrosse head portion with respect to the lacrosse stick handle portion.

22. An articulated lacrosse stick comprising: a rigid lacrosse stick handle structured and arranged to be gripped by two hands of a lacrosse player;

a lacrosse head structured and arranged to receive a lacrosse ball; and an articulation means for allowing articulation of the lacrosse head with handle with reject to the lacrosse stick.

23. The lacrosse stick of claim 22, wherein the means for articulating the lacrosse head comprises an articulation mechanism for displacing the lacrosse head portion from a longitudinal axis of the lacrosse stick handle portion by a displacement angle of up to about 60 degrees.

24. The lacrosse stick of claim 22, wherein the displacement angle is from about 1 degree to about 10 degrees.

25. The lacrosse stick of claim 22, wherein the displacement angle is from about 2 degrees to about 5 degrees.

* * * * *

UNITED STATES PATENT AND TRADEMARK OFFICE

CERTIFICATE OF CORRECTION

PATENT NO. : 7,282,000 B2
APPLICATION NO. : 10/800560
DATED : October 16, 2007
INVENTOR(S) : William H. Brine, III and Barclay Moore It is certified that error appears in the above-identified patent and that said Letters Patent is hereby corrected as shown below:

Claims:
Column 13, Line 11 (Claim 22)
"...an articulation means for allowing articulation of the lacrosse head with handle with reject to the lacrosse stick" should read -- an articulation means for allowing articulation of the lacrosse head with respect to the lacrosse stick handle --

Signed and Sealed this

Sixth Day of May, 2008

JON W. DUDAS
*Director of the United States Patent and Trademark Office*